US006679597B2

(12) United States Patent
Ohsawa et al.

(10) Patent No.: US 6,679,597 B2
(45) **Date of Patent: *Jan. 20, 2004**

(54) INKJET PRINTING METHOD AND PRINTING APPARATUS

(75) Inventors: Sadao Ohsawa, Shizuoka (JP); Yusuke Nakazawa, Shizuoka (JP); Mutsumi Naniwa, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/100,902

(22) Filed: Mar. 20, 2002

(65) Prior Publication Data

US 2002/0180853 A1 Dec. 5, 2002

(30) Foreign Application Priority Data

Mar. 21, 2001 (JP) ..... P. 2001-080722
Mar. 30, 2001 (JP) ..... P. 2001-101235

(51) Int. Cl.[7] ..... B41J 2/17; B41J 2/18
(52) U.S. Cl. ..... 347/95; 347/89
(58) Field of Search ..... 347/84–86, 89, 347/95, 100, 104; 101/463.1, 450.1

(56) References Cited

U.S. PATENT DOCUMENTS 4,607,261 A * 8/1986 McCann et al. ..... 346/75
6,454,401 B2 * 9/2002 Naniwa et al. ..... 347/89

FOREIGN PATENT DOCUMENTS

| | | |
|---|---|---|
| EP | 0770486 A | 5/1997 |
| JP | 05249783 A | 9/1993 |
| JP | 10-286939 | 10/1998 |

OTHER PUBLICATIONS

Abstract of JP 2000–280438 A (Fuji Photo Film Co. LTD) (Publication Date, Oct. 10, 2000) from Patent Abstracts of Japan, vol. 2000, No. 13, Feb. 5, 2001.

Abstract of JP 10–286962 A (NEC NIIGATA LTD) (Publication Date, Oct. 27, 1998) from Patent Abstracts of Japan, vol. 1999, No. 1, Jan. 29, 1999.

* cited by examiner

*Primary Examiner*—Stephen D. Meier
*Assistant Examiner*—An H. Do
(74) *Attorney, Agent, or Firm*—Sughrue Mion, PLLC

(57) ABSTRACT

Inkjet printing method having the following steps: ejecting an oily ink comprising particles to a printing medium with use of an electrostatic field according to image data signals to form an image directly on the printing medium; and fixing the image to obtain a printed matter, wherein a prevention of an aggregation and/or a precipitation of the particles is conducted at least during ink circulation, or an aggregate and/or a deposit of the particles formed at least due to a suspension of ink-flow is redispersed.

15 Claims, 11 Drawing Sheets

INKJET PRINTING METHOD AND PRINTING APPARATUS

FIELD OF THE INVENTION

The present invention relates to an inkjet printing method and printing apparatus forming an image directly on a printing medium based on electrostatic inkjet recording with use of an oily ink and being capable of achieving a high print quality and a large printing speed. More specifically, the invention relates to a prevention of the aggregation and/or precipitation of the particles in the oily ink and a redispersion of the ink used for such a method.

BACKGROUND OF THE INVENTION

As printing methods of forming a print image on a printing medium on the basis of image data signals, the methods based on electrophotography, thermal dye sublimation, thermal melting transfer and inkjet recording are known.

Electrophotography requires processes for forming an electrostatic latent image on a photosensitive drum by charging and exposure, and the system tends to become complicated requiring an expensive apparatus.

In thermal transfer processes, the apparatus is inexpensive, but suffers from a high running cost and the generation of waste as the processes use an ink ribbon.

In contrast, inkjet processes require inexpensive apparatuses and enjoy a low running cost because a direct printing is performed on a printing medium whereby the ink is ejected only onto image areas needed for image formation.

As a method of applying the inkjet technology to printing system, Japanese Patent Laid-Open No. 286939/1998 discloses a printing method comprising adding an inkjet printing apparatus to a rotary press machine, and additionally printing variable numbers or marks on the same printed matters with the inkjet system.

It is further desirable that a printing system can print high-quality image information such as photographic images. Unfortunately, however, with the conventional ink technique that ejects an aqueous or organic solvent-based ink containing dyes or pigments as the colorant by pressure, liquid droplets containing a large amount of solvent are ejected and thus tend to cause blur in the printed image when an expensive dedicated type of paper is not used.

Accordingly, high quality printed images cannot be obtained when ordinary non-dedicated printing stocks or plastic sheets, which are non-absorbent media, are used for printing.

As one of the inkjet techniques, there is known an image-forming method ejecting ink melted and liquefied by applying heat to an ink material that is solid at ambient temperature. By using this type of ink, the blur of the printed image is mitigated, but due to the high ink viscosity during ejection, it is difficult to eject fine droplets, thus the individual printed dot has a large area as well as a large thickness. Accordingly, the formation of high-resolution images is quite difficult.

Furthermore, in image recording by an inkjet process, there take place various problems such as pipe or head choking caused by the precipitation and aggregation of the particulate ingredients in the ink, thus making ink ejection unstable, deteriorating image quality and at the worst terminating ink ejection. In cases where the size of the dispersed particles is large, they tend to sediment when the ink is stationary whereby ink ejection at a constant particle concentration and thus normal image recording become impossible. Furthermore, in some cases, ink ejection completely stops.

Furthermore, after ink-flow is suspended in inkjet recording, aggregates or deposits of the particulate materials in the ink, or foreign matters such as dust sometimes act to choke the ink-flow pipe or the head, thus causing various problems such as unstable ink ejection which leads to image quality deterioration, and at the worst termination of ink ejection. In cases where the size of the dispersed particles is large, they tend to sediment when the ink is stationary whereby ink ejection at a constant particle concentration and thus normal image recording become impossible.

SUMMARY OF THE INVENTION

The invention has been devised by taking notice of the above-cited problems; the object of the invention is to provide an inkjet printing method and printing apparatus which can consistently output sharp and crisp prints by an inexpensive and simple process free of developing treatments, and which cope with digital signals.

As a result of eager investigation of the present inventors for solving the above problems, the present invention has been attained by the following means (1) to (21).

(1) Inkjet printing method comprising:
- ejecting an oily ink comprising particles to a printing medium with use of an electrostatic field according to image data signals to form an image directly on the printing medium; and
- fixing the image to obtain a printed matter,
- wherein a prevention of an aggregation and/or a precipitation of the particles is conducted at least during ink circulation, or
- an aggregate and/or a deposit of the particles formed at least due to a suspension of ink-flow is redispersed.

(2) The inkjet printing method as described in (1) above, wherein the oily ink comprises:
- a nonaqueous solvent having a specific resistance not less than $10^9$ Ωcm and a dielectric constant not higher than 3.5 and; and
- colored particles dispersed in the nonaqueous solvent.

(3) An inkjet printing apparatus comprising:
- an image-forming means for forming an image directly on a printing medium according to image data signals; and
- an image-fixing means for fixing the image formed by the image-forming means to produce a printed matter, the image-forming means being an inkjet recording unit comprising a recording head that ejects an oily ink comprising particles with use of an electrostatic field,
- wherein at least one aggregation and/or precipitation-preventing means is equipped in an ink-flow channel of the oily ink in an ink circulation, the aggregation and/or precipitation-preventing means being for a prevention of aggregation and/or precipitation of the particles, or
- a redispersing means is equipped, the redispersing means being for redispersing of the particles which are in a state of aggregation and/or precipitation formed due to a suspension of ink-flow.

(4) The inkjet printing apparatus as described in (3) above, wherein at least one of the aggregation and/or precipitation-preventing means and the redispersing means is located just in front of an ink-ejecting part of the recording head.

(5) The inkjet printing apparatus as described in (3) or (4) above, wherein at least one of the aggregation and/or precipitation-preventing means and the redispersing means comprises a step selected from agitation, dispersion, mixing and jetting.

(6) The inkjet printing apparatus as described in (5) above, wherein the steps of agitation, dispersion, mixing and jetting are applied individually or in combination.

(7) The inkjet printing apparatus as described in (6) above, wherein the steps of agitation, dispersion, mixing and jetting are applied with a fixed interval, with a non-fixed interval or continuously.

(8) The inkjet printing apparatus as described in any one of (3) to (7) above, wherein at least one of the aggregation and/or precipitation-preventing means and the redispersing means is in the form of a cartridge.

(9) The inkjet printing apparatus as described in any one of (3) to (8) above, wherein the oily ink comprises:

a nonaqueous solvent having a specific resistance not less than $10^9$ Ωcm and a dielectric constant not higher than 3.5 and; and colored particles dispersed in the nonaqueous solvent.

(10) The inkjet printing apparatus as described in any one of (3) to (9) above, which further comprises a dust-removing means that removes dusts present on a surface of the printing medium prior to and/or during printing.

(11) The inkjet printing apparatus as described in any one of (3) to (10) above, wherein the image forming is carried out by moving the printing medium through s rotation of a counter drum arranged in a position facing the recording head with the printing medium interposed between the recording head and the drum.

(12) The inkjet printing apparatus as described in (11) above, wherein the recording head is of a single-channel or multi-channel type and the image forming is carried out by moving the recording head in the direction parallel to the axis of the counter drum.

(13) The inkjet printing apparatus as described in any one of (3) to (12) above, wherein the image forming is carried out by transporting the printing medium inserted between at least a pair of capstan rollers.

(14) The inkjet printing apparatus as described in (13) above, wherein the recording head is of a single-channel or multi-channel type, and the image forming is carried out by moving the recording head along the direction perpendicular to the moving direction of the printing medium.

(15) The inkjet printing apparatus as described in any one of (3) to (14) above, wherein the recording head is of a full-line type having a width substantially equal to that of the printing medium.

(16) The inkjet printing apparatus as described in any one of (3) to (15) above, wherein the inkjet recording unit further comprises an ink-feeding member that feeds the oily ink to the recording head.

(17) The inkjet printing apparatus as described in (16) above, which further comprises an ink-recovery means that gathers the oily ink from the recording head and circulates the oily ink.

(18) The inkjet printing apparatus as described in any one of (3) to (17) above, wherein the inkjet recording unit further comprises an agitating means for agitating the oily ink in an ink tank that stores the oily ink.

(19) The inkjet printing apparatus as described in any one of (3) to (18) above, wherein the inkjet recording unit further comprises a contrlooing means for controlling the temperature of the oily ink kept in a ink tank that stores the oily ink.

(20) The inkjet printing apparatus as described in any one of (3) to (19) above, wherein the inkjet recording unit further comprises an ink concentration-controlling means that controls the concentration of the oily ink.

(21) The inkjet printing apparatus as described in any one of (3) to (20) above, which further comprises a cleaning means that cleans the recording head.

BRIEF DESCRIPTION OF THE DRAWINGS

FIG. 1 is a schematic diagram showing the entire constitution of an inkjet printing unit comprising a control unit, an ink-feeding unit, and a head distancing/approximating mechanism for an inkjet printing apparatus of the invention.

FIG. 2 is a diagram showing the constitution of a printing apparatus that is additionally equipped with an ink-circulating function to the ink-feeding unit depicted in FIG. 1.

FIG. 3 is a bird-eye view of a specific example for the ink-ejecting head depicted in FIG. 1.

FIG. 4 is a diagram used to explain the enlarged cross-section of the ink-ejecting imaging unit depicted in FIG. 3.

FIG. 5 is a diagram schematically showing the cross-section of the vicinity of the ink-ejecting part of another example of the ink-ejecting head.

FIG. 6 is a diagram schematically showing the front view of the vicinity of the ink-ejecting part of still another example of the ink-ejecting head.

FIG. 7 is a diagram schematically showing only a part of still another ink-ejecting head.

FIG. 8 is a schematic diagram of the recording head shown in FIG. 7 from which regulating plates 42 and 42' have been removed.

FIG. 9 is a schematic diagram showing part of the ejecting head for another example having a pair of substantially rectangular-shaped supporting members.

FIG. 10 is a diagram showing an apparatus that is a partial modification of the one shown in FIG. 2.

FIG. 11 is a schematic cross-sectional view showing an aggregation and/or precipitation-preventing member and/or a redispersing member.

FIG. 12 is a schematic cross-sectional view showing another aggregation and/or precipitation-preventing member and/or a redispersing member.

FIG. 13 is a schematic cross-sectional view showing still another aggregation and/or precipitation-preventing member and/or a redispersing member.

FIG. 14 is a schematic cross-sectional view showing still another aggregation and/or precipitation-preventing member and/or a redispersing member.

FIG. 15 schematically illustrates the entire constitution of a web-type apparatus performing a single-sided monochrome printing as an example of the inkjet printing apparatus of the invention.

FIG. 16 schematically illustrates the entire constitution of a web-type apparatus performing a single-sided four-color printing as another example of the inkjet printing apparatus of the invention.

FIG. 17 schematically illustrates the entire constitution of a double-sided four-color printing apparatus as another example of the inkjet printing apparatus of the invention.

FIG. 18 schematically illustrates the entire constitution of a double-sided four-color printing apparatus as still another example of the inkjet printing apparatus of the invention.

FIG. 19 schematically illustrates the entire constitution of a single-sided four-color printing apparatus in which a rolled printing medium is cut and wound around a counter drum for performing printing as another example of the inkjet printing apparatus of the invention.

FIG. 20 schematically illustrates the entire constitution of a printing apparatus in which a sheet-formed printing medium is used, as another example of the inkjet printing apparatus of the invention.

FIG. 21 schematically illustrates the entire constitution of a printing apparatus in which a rolled printing medium is conveyed by being inserted between a pair of capstan rollers as another example of the inkjet printing apparatus of the invention.

FIG. 22 schematically illustrates the entire constitution of a printing apparatus in which a sheet-formed printing medium is conveyed by being inserted between a pair of capstan rollers, as another example of the inkjet printing apparatus of the invention.

DESCRIPTION OF THE REFERENCE NUMERALS AND SIGNS

Figure 1:
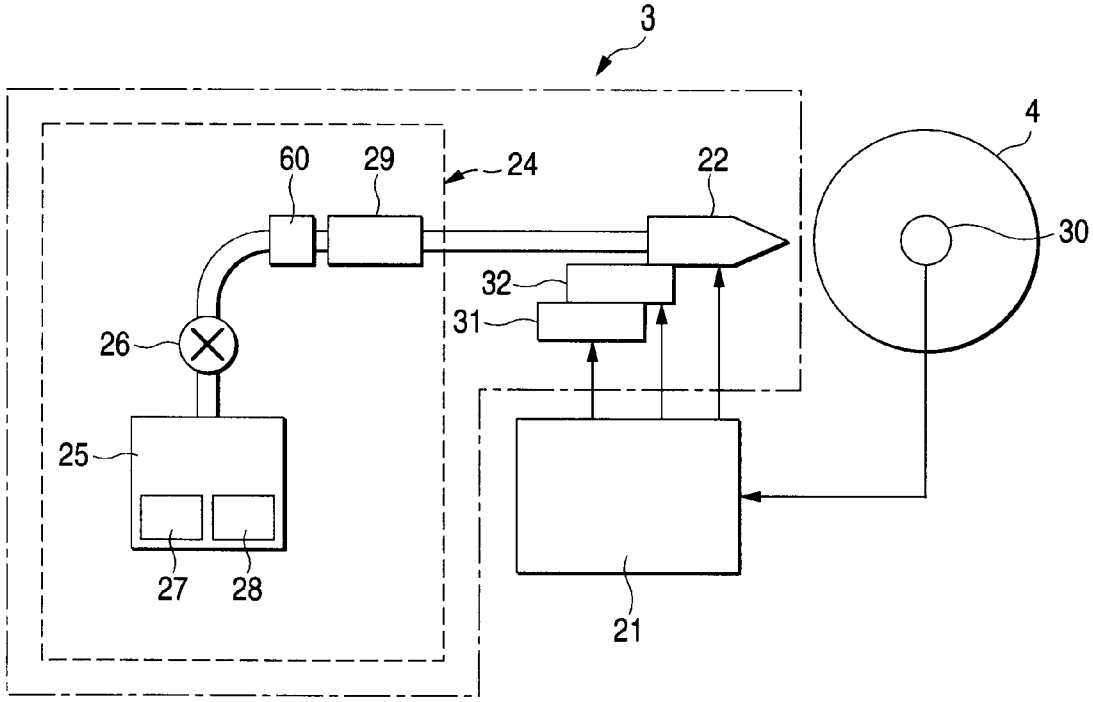
[FIG. 1]

| | |
|---|---|
| 1 | Printing medium-feeding roll |
| 2 | Dust-removing unit |
| 3 | Inkjet recording unit |
| 4 | Counter (Imaging) drum |
| 5 | Fixing unit |
| 6 | Printing medium-winding roll |
| 7 | Automatic exhausting unit |
| 8 | Cutter |
| 9 | Automatic feeding unit |
| 10 | Capstan rollers |
| 11 | Earth member |
| 21 | Image data processing-controlling unit |
| 22 | Ejecting head |
| 221 | Upper block |

-continued

| | |
|---|---|
| 222 | Lower block |
| 22a | Ejecting slit |
| 22b | Ejecting electrode |
| 23 | Oily ink |
| 24 | Ink-feeding unit |
| 25 | Ink tank |
| 26, 26' | Ink-feeding device |
| 27 | Agitating member |
| 28 | Ink temperature-controlling member |
| 29 | Ink concentration-controlling member |
| 30 | Encoder |
| 31 | Head distancing/approximating unit |
| 32 | Head sub-scanning means |
| 33 | First insulating base material |
| 34 | Second insulating base material |
| 35 | Slanted end of the second insulating base material |
| 36 | Upper plane of the second insulating base material |
| 37 | Ink inflow channel |
| 38 | Ink recovery channel |
| 39 | Backing |
| 40 | Slot |
| 41 | Head body |
| 42, 42' | Meniscus regulating plate |
| 43 | Ink slot |
| 44 | Dividing wall |
| 45, 45' | Ejecting point |
| 46 | Dividing wall |
| 47 | Tip of the dividing wall |
| 50, 50' | Supporting member |
| 51, 51' | Slot |
| 52 | Dividing wall |
| 53 | Upper end |
| 54 | Rectangular part |
| 55 | Upper end of the dividing wall |
| 56 | Guiding projection |
| 61, 61' | Valve |
| 70 | Agitating motor |
| 71 | Agitating blade |
| 72 | Pump |
| 81 | Agitating element |
| 82 | Stirrer |
| 83 | Ultrasonic wave-applying tub |
| 84 | Ultrasonic vibrating element |
| 85 | Ultrasonic vibrator |
| 86 | Vibrating blades |
| 87 | Oscillator |
| M | Printing medium |

DETAILED DESCRIPTION OF THE INVENTION

In the following, the mode for carrying out the invention will be described in detail.

The invention is characterized by that, in the formation of images by an inkjet method in which an oily ink is ejected by an electrostatic field onto a printing medium fed to a printing apparatus and the oily ink particles are prevented from aggregation and precipitation and/or the oily ink is redispersed.

The inkjet method associated with the invention is one described in PCT Publication W093/11866 wherein use is made of an ink of high electric resistance containing at least colored particles dispersed in an insulating solvent. To such an ink, an intense electrostatic field is applied at an ejecting position to form aggregates of said colored particles there and cause said aggregate to eject by electrostatic means from said ejecting position. As the colored particles eject as highly concentrated aggregates, the ink droplets contain only a small amount of solvent. Due to such a fact, high-density, sharp and crisp images free of blur are formed on a printing stock or a plastic film both designed for printing media.

In the invention, the size of the ejected ink droplets is determined by the dimension of the ejecting electrode and the conditions of electrostatic field application. Thus, by adopting a small ejecting electrode and optimized electrostatic field application conditions, one can realize minute ink droplets without reducing the ink-ejecting nozzle diameter or slit width.

Accordingly, a fine control on minute image formation is possible without accompanying the drawback of head choking with ink. Therefore, the invention provides an inkjet printing method capable of producing printed matters containing sharp and crisp images.

Now, an example of a printing apparatus associated with the invention is explained in detail with reference to FIG. 1.

FIG. 1 schematically shows a structural example of an inkjet recording unit comprising a control unit, an ink-feeding unit and a head approximating/distancing mechanism.

As is shown in FIG. 1, inkjet recording unit 3 used for the present inkjet printing method comprises ejecting head 22 and ink-feeding unit 24.

Ink-feeding unit 24 further contains ink tank 25, ink-feeding unit 26 and ink concentration controlling means 29. Ink tank 25 is provided with agitating member 27 and ink temperature controlling means 28. The ink may be circulated in the head as will be shown in FIG. 2. In such a case, the ink-feeding unit has collecting and circulating functions. Agitating member 27 acts to prevent the ink by agitation from aggregation and precipitation and/or to redisperse the ink by agitation to suppress the precipitation or aggregation of the solid ingredients in the ink. Agitating member 27 includes rotary blades, an ultrasonic vibrator and a circulation pump. One can adopt one or more from these means. A more detailed description will be given later. Ink temperature-controlling means 28 is arranged in such a manner as to secure consistent formation of high quality images by suppressing the change in the ink property as well as the change in the dot diameter caused by the change in the ambient temperature. Various conventionally known methods for ink temperature control may be adopted including provision of a heat-generating or cooling element such as a heater or a Peltier element in the ink tank together with an agitating member that is equipped so as to achieve a uniform temperature distribution within said tank and a temperature sensor exemplified by a thermostat that controls temperatures. The ink temperature is preferably 15 to 60° C., more preferably 20 to 50° C. The agitating member that is equipped so as to achieve a uniform temperature distribution in said tank may be commonly used for the prevention of the precipitation or aggregation of the solid ingredients in the ink.

Figure 2:
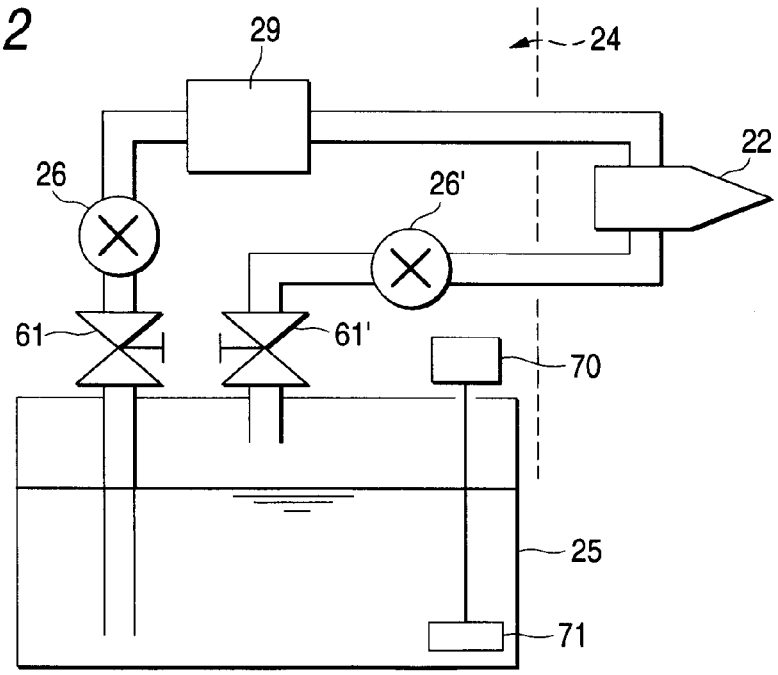
[FIG. 2]

FIG. 2 shows the structure of ink-feeding unit 24 having an ink-collecting function. As is shown in the figure, ink-feeding unit 24 has, in addition to valve 61, pump 26 to feed ink to ejecting head 22, and ink concentration controlling means 29, circulation-collection pump 26' and valve 61' both used for the circulation and collection of ink from the head. Though there are a variety of aggregation/precipitation-preventing members and/or redispersing means as have been described heretofore, the figure illustrates agitating motor 70 and agitating blades 71. With use of these devices, an ink which contains oily ink particles in a finely dispersed condition free of aggregates or precipitates can be supplied to ink-ejecting head 22. By arranging a filtering member such as a filter just in front of ejecting head 22, one can feed to ejecting head 22 ink in a normal dispersion state containing neither paper fiber nor dust.

To output high quality images, the present ink-ejecting printing apparatus 3 is preferably provided with ink concentration control means 29. Ink concentration can be controlled by optical detection, measuring electrical conductance, measuring physical properties such as viscosity, or by the number of output sheets. In the case of the control based on physical property measurement, an optical detector, an electrical conductance-measuring device or a viscosity-measuring device is installed in the ink tank or the ink flow channel whereby such devices are used individually or in combination, and the control is performed by the output signals thereof. When the ink concentration is controlled by the number of printed sheets, feeding from an ink concentrate tank for replenishment or from an ink carrier tank for dilution, both tanks being not shown in the figure, is controlled based on the number of print and printing frequency.

In the figure, 21 designates an image data processing-controlling unit, which calculates input image data and receives the timing pulses from encoder 30 provided in head distancing/approximating unit 31, a counter drum or capstan rollers and drives the head by the pulses. To conduct printing with ink-ejecting recording unit 3, counter drum 4 is driven with a high-precision driving means. Specifically, for example, the recording drum is driven by decelerating the output of a high-precision motor by means of a high-precision gear or a steel belt. By jointly using one or more of these means, extremely high-quality recording can be conducted.

Image data processing-controlling unit 21 receives image data from an image scanner, a magnetic disc unit and an image data transmission unit, and performs color separation, performs division calculation of proper pixel numbers and gradation numbers on the color-separated data, and distributes them to each head. Further, in order to output oily, halftone inkjet images by using ink-ejecting head 22 of inkjet recording unit 3, area coverage values are calculated, too.

Image data processing-controlling unit 21 controls not only the movement of inkjet ejecting head 22 and the ejection timing of the oily ink, but also the timing for moving the printing medium if necessary. Specifically, image data from a magnetic disc unit and the like are given to image data processing-controlling unit 21. Image data processing-controlling unit 21 performs the calculation of the ejecting position of the oily ink and the dot coverage at that position in accordance with the input image data. These processed data are once stored in a buffer. By using head distancing/approximating unit 31, image data processing-controlling unit 21 moves ejecting head 22 to a position close to the printing medium which is in contact with the imaging drum. The spacing between ejecting head 22 and the surface of the imaging drum is kept at a pre-determined value during recording by mechanical distance control such as with a knocking roller or by the control of a head distancing/approximating unit operated by the signals from an optical gap detector. Ejecting head 22 may comprise a single channel head, multi-channel heads or full-line heads.

When a single channel head or a multi-channel-type head is used as ejecting head, the ejecting part(s) is (are) arranged substantially in parallel to the conveyance direction of the printing medium. And main scanning is performed by the movement of the ejecting head in the axial direction of the counter drum, while sub-scanning is performed by the rotation of the counter drum to thereby effect image recording. These movements of the counter drum and the ejecting head(s) are controlled by image data processing-controlling unit 21, and the head(s) ejects (eject) an oily ink on the printing medium on the basis of the ejecting position and the dot coverage obtained by the calculation cited above. Thus, a dot image is formed on the printing medium with the oily ink corresponding to the density distribution of the original. This action continues until a predetermined ink image completes on the printing medium.

On the other hand, when ejecting heads 22 are of a full-line-type having a length substantially equal to the width of the drum, the ejecting parts are arranged substantially perpendicular to the conveyance direction of the printing medium. And with the printing medium passing the imaging point by the rotation of the counter drum, an image composed of the oily ink is formed to provide a printed matter.

After completion of printing, the ejecting head 22 is driven to retreat from the position close to the imaging drum for protection whereby only ejecting head 22 may be recessed or together with ink-feeding means 24.

This distancing/approximating member 31 acts to separate the recording head by at least 500 μm apart from the image recording drum 4 except during imaging. Such a separating action may be performed with a sliding mechanism, or with an arm fixed to a certain axis, around which the arm is rotated to cause a pendulum-like movement of the head. With such a head retreat during its suspended period, the head is protected from physical damage or contamination, thus achieving a long life.

Next, ejecting head 22 will be explained with use of FIGS. 3 to 9, which are used to describe ink-ejecting head 22 equipped in the inkjet recording unit shown in FIG. 1. However, the scope of the invention is not restricted to the examples to follow.

Figure 3:
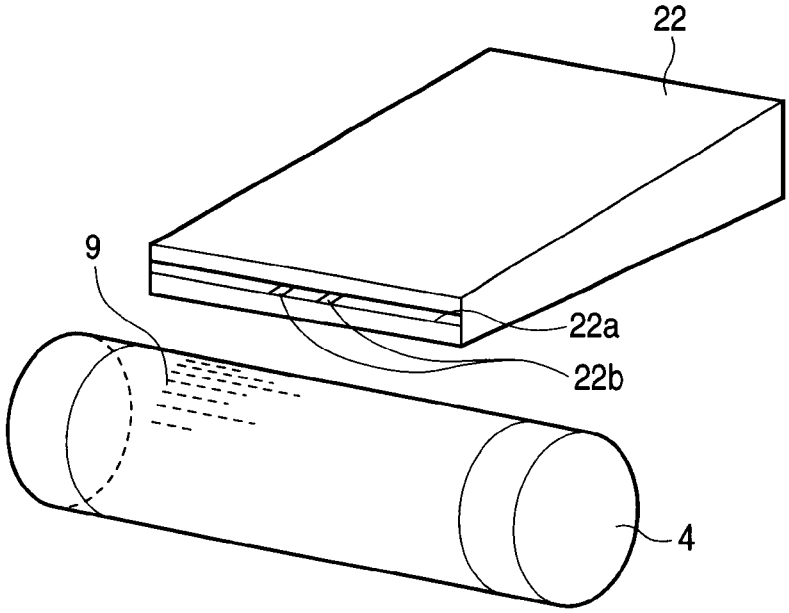
[FIG. 3]
Figure 4:
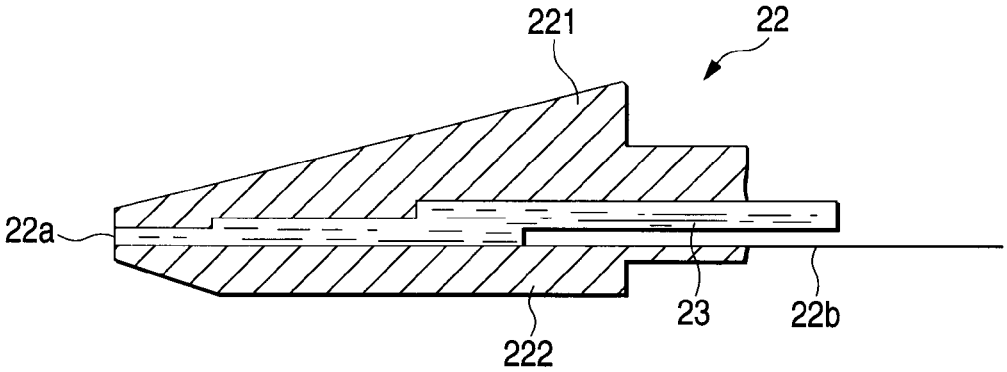
[FIG. 4]

FIGS. 3 and 4 illustrate an example of a head equipped in the inkjet imaging unit. Ejecting head 22 has ink-ejecting slit formed between upper block 221 and lower block 222, both made of insulating base materials, and the tip of the head forms ejecting slit 22*a*. Ejecting electrode 22*b* is arranged in the slit, and the slit is filled with ink 23 fed from an ink-feeding unit. As the insulating base material, plastics, glasses or ceramics can be used. Ejecting electrode 22*b* can be fabricated by well-known methods such as a method comprising vacuum deposition, sputtering or electroless plating of an electrically conductive material including aluminum, nickel, chromium, gold or platinum on lower block 222 made of an insulating base material, coating a photo-resist thereon, exposing the photo-resist through a mask of prescribed electrode pattern, developing the exposed photo-resist to develop a photo-resist pattern of ejecting electrode 22*b*, and etching the conductive material imagewise, or a method based on mechanical removal of the conductive material, or combinations of these methods.

To ejecting electrode 22*b* of ejecting head 22 is applied a potential modulated by the digital signals representing an image pattern. As is shown in FIG. 3, an image-recording drum is arranged so as to face and act as the counter electrode of ejecting electrode 22*b*, and a printing medium is loaded on the image-recording drum. With voltage application, an electric circuit is formed between ejecting electrode 22*b* and the image-recording drum acting as the counter electrode, thus causing oily ink 23 to eject from ejecting slit 22*a* of ejecting head 22, and an image is formed on the printing medium loaded on the image-recording drum.

The width of electrode 22*b* should be as small as possible for high quality image formation. Though the specific numerical value differs depending on the conditions such as electrode spacing and applied voltage, the tip of from 5 to 100 μm in width is generally used.

For instance, when the tip of ejecting electrode 22*b* is 20 μm wide, a 40 μm size dot can be formed on printing medium 9 with the distance of 1.0 mm between electrode 22*b* and imaging drum 4 acting as the counter electrode under the application of 3 kV between these two electrodes for 0.1 msec.

Figure 5:
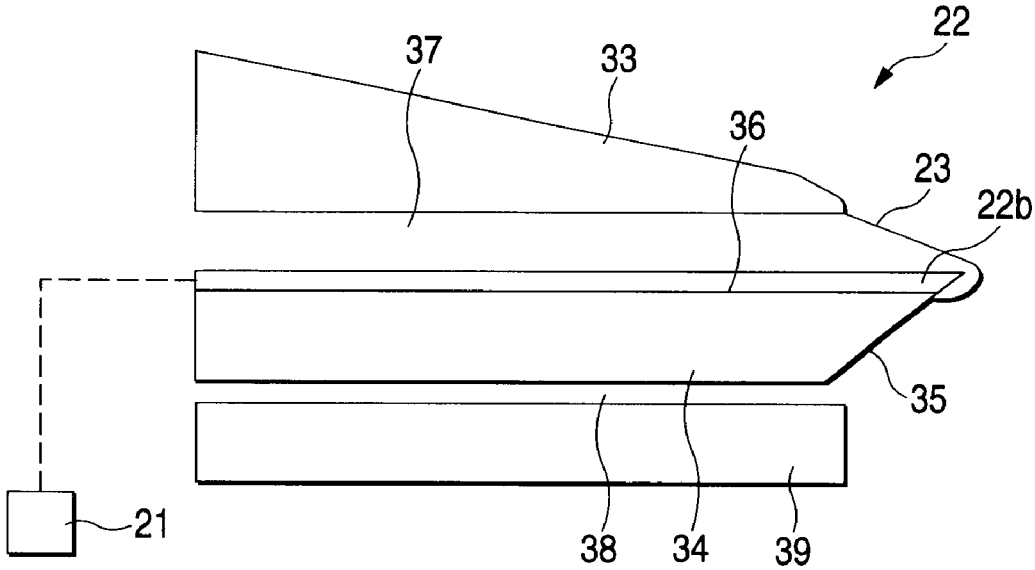
[FIG. 5]
Figure 6:
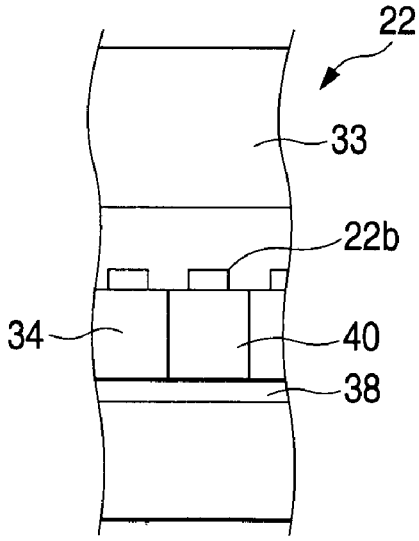
[FIG. 6]

FIGS. 5 and 6 depict schematically the cross-sectional and front views of the vicinity of the ink-ejecting part in another type of ejecting head, respectively. In the figures, symbol 22 indicates an ejecting head, which has a first insulating base material 33 of tapered shape. A second insulating base material 34 faces this first insulating base material 33 with an intervening space, and at the tip of this second insulating base material 34 is formed beveled part 35. These first and second insulating base materials are made of, for example, plastic, glass or ceramic. On the upper plane 36 forming an acute angle with beveled part 35 of second insulating base material 34 are provided a plurality of ejecting electrodes 22*b* as electrostatic field-forming means at the ejecting parts. The tips of these plural electrodes 22*b* extend to the vicinity of the upper plane 36 described above, and protrude beyond the end of first insulating base material 33, thus forming ink-ejecting parts. The space between the first and second insulating base materials 33 and 34 makes ink inflow channel 37 as means of supplying ink 23 to the ejecting point, and ink recovery channel 38 is formed under the lower side of second insulating base material 34. Ejecting electrodes 22*b* are formed on second insulating base material 34 with an electrically conductive material such as aluminum, nickel, chromium, gold or platinum according to any conventional method well known in the art as described above. Each electrode 22*b* is formed so as to be electrically insulated from each other. The length by which the tip of ejecting electrode 22*b* protrudes beyond the end of insulating base material 33 should not exceed 2 mm. The reason of restricting the protrusion length to the above range is that, if this length is too large, the ink meniscus will not reach the end of the ejecting electrode thus making ink-ejection difficult, or lowering the recording frequency. The clearance between first and second insulating base materials 33 and 34 is preferably from 00.1 to 3 mm. The reason of restricting the clearance to the above range is that narrower clearances than this range make ink-feed difficult, and also cause the drop of recording frequency, and that broader spaces make the ink meniscus unstable, causing ink ejection inconsistent. The above ejecting electrode 22*b* is connected to image data processing-controlling unit 21, which, during printing, applies voltage to the ejecting electrode to cause the ink on the ejecting electrode to eject. In this way, imaging is performed on a printing medium (not shown in the figure) arranged to face the ejecting point. The direction opposite to the ink droplet ejecting direction of inflow channel 37 is connected to the ink-feeding means of the ink-feeding device not shown in the figure. Backing 39 is provided on the counter side to the surface of second insulating base material 34 opposite to the surface on which the ejecting electrodes are formed with a clearance therebetween which forms ink recovery channel 38. The clearance of ink recovering channel 38 is preferably 0.1 mm or larger. The reason why the clearance is restricted in the above range is that if the clearance is too narrow, the ink recovery becomes difficult leading to ink leakage.

Ink recovery channel 38 is connected to the ink recovery member of an ink-feeding device not shown in the figure. In the case where a uniform ink flow on the ejecting point is needed, thin grooves 40 may be provided between the ejecting point and the ink recovery channel. FIG. 6 is the front schematic diagram of the vicinity of the ink-ejecting point, in which a plurality of grooves 40 are provided on the bevel of second insulating base material 34 running from the vicinity of the boundary with electrode 22*b* toward ink recovery channel 38. These plural grooves 40, which are arranged side by side in plurality in the direction of the array of ejecting electrode 22*b*, act to attract a constant amount of the ink in the vicinity of the aperture in the side of electrode 22*b* from the aperture in ejecting electrode 22*b* by a capillary force determined by the electrode aperture size and discharge the attracted ink to recovery channel 38. To achieve these actions, grooves 40 have a function of forming an ink-flow with a constant layer thickness in the vicinity of the tip of the ejecting. As for the shape and size of grooves 40, which are designed so as to exert a sufficient capillary force, the width is made preferably from 10 to 200 μm, and the depth is preferably made 10 to 300 μm. Grooves 40 are provided in a number necessary to form a uniform ink-flow on the entire surface of the head.

The tip width of ejecting electrode 22*b* should be as small as possible for the formation of high-resolution images. Usually, the tip width of from 5 to 100 μm is preferred, though the specific numerical value differs depending on electrode spacing, applied voltage, etc.

Figure 7:
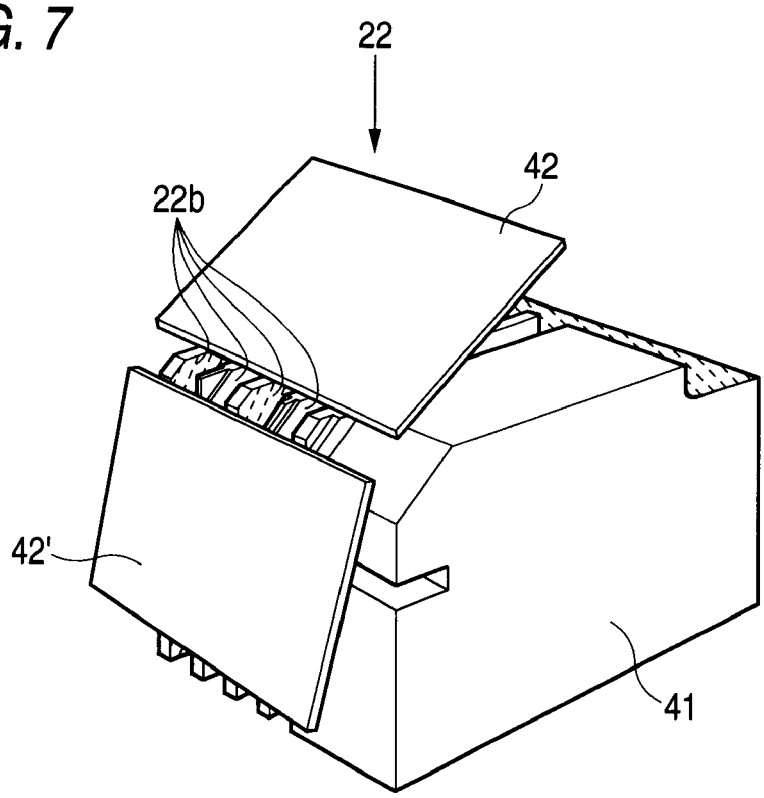
[FIG. 7]
Figure 8:
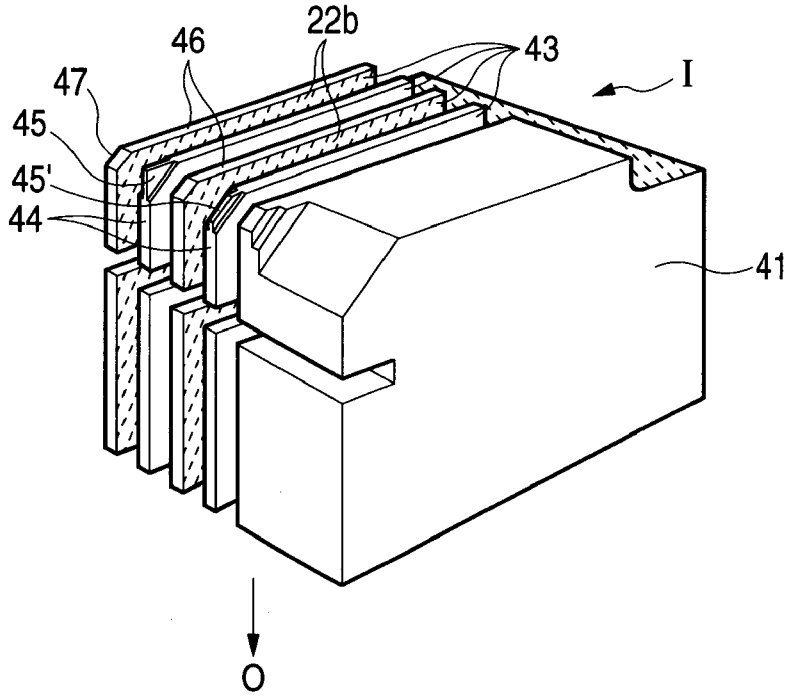
[FIG. 8]

Another example of the ejecting head used in practicing the invention is illustrated in FIGS. 7 and 8. FIG. 7 depicts schematically a part of such a head for explanation. Head 22 consists of head body 41 made of an insulating material such as plastic, ceramic or glass, and meniscus regulating plates 42 and 42'. In the figure, symbol 22*b* indicates an ejecting electrode that applies voltage for the formation of electrostatic field at the ejecting point. Further, a more detailed description of the head body will be made with reference to FIG. 8 in which meniscus regulating plates 42 and 42' are removed. Perpendicularly to the edge of head body 41, plural ink slots 43 are provided for ink circulation. The shape and size of ink slot 43, which are designed within the range that the capillary force reaches so as to achieve a uniform ink-flow, should preferably be 10 to 200 μm wide and 10 to 300 μm deep. Ejecting electrode 22*b* is provided in each ink slot 43. These electrodes can be formed on head body 40 made of an insulating material with the use of an electroconductive material such as aluminum, nickel, chromium, gold or platinum according to the well-known methods cited in the description of the example of the imaging unit to entirely or partly cover the surface of slot 43. Each of the plural ejecting electrodes is electrically isolated from each other. Adjacent two slots form a single cell, and at the tip of dividing wall 44 located in the center of the cell, ejecting points 45 and 45' are provided. At these ejecting points 45 and 45', the dividing wall is fabricated thinner than the remaining area thereof, thus forming sharp edges. Such a structure of the head body can be made by any method known in the art including mechanical processing, etching or molding a block of the insulating material. The thickness of the dividing wall is preferably from 5 to 100 μm, and the diameter of curvature at the sharpened edge is preferably in the range of 5 to 50 μm. The corner of the point may be slightly chamfered such as 45' shown in the figure. The figure depicts only two cells, and the cells are separated with dividing wall 46, and its tip 47 is beveled in such a manner that tip 47 stands back relative to ejecting points 45 and 45'. An ink-feeding device of an ink-feeding unit not shown in the figure supplies ink to the ejecting point via the ink slots from the direction designated by I. Further, excessive ink is collected by an ink recovery means not shown in the figure to the direction designated by O. Thus, the ejecting point is always supplied with fresh ink. In such a state of the head body, the ink is ejected from the ejecting point to a printing medium mounted on an imaging (counter) drum (not shown in the figure) facing the ejecting point by applying signal voltage modulated by image data to the ejecting electrode, and an image is formed on the printing medium.

Figure 9:
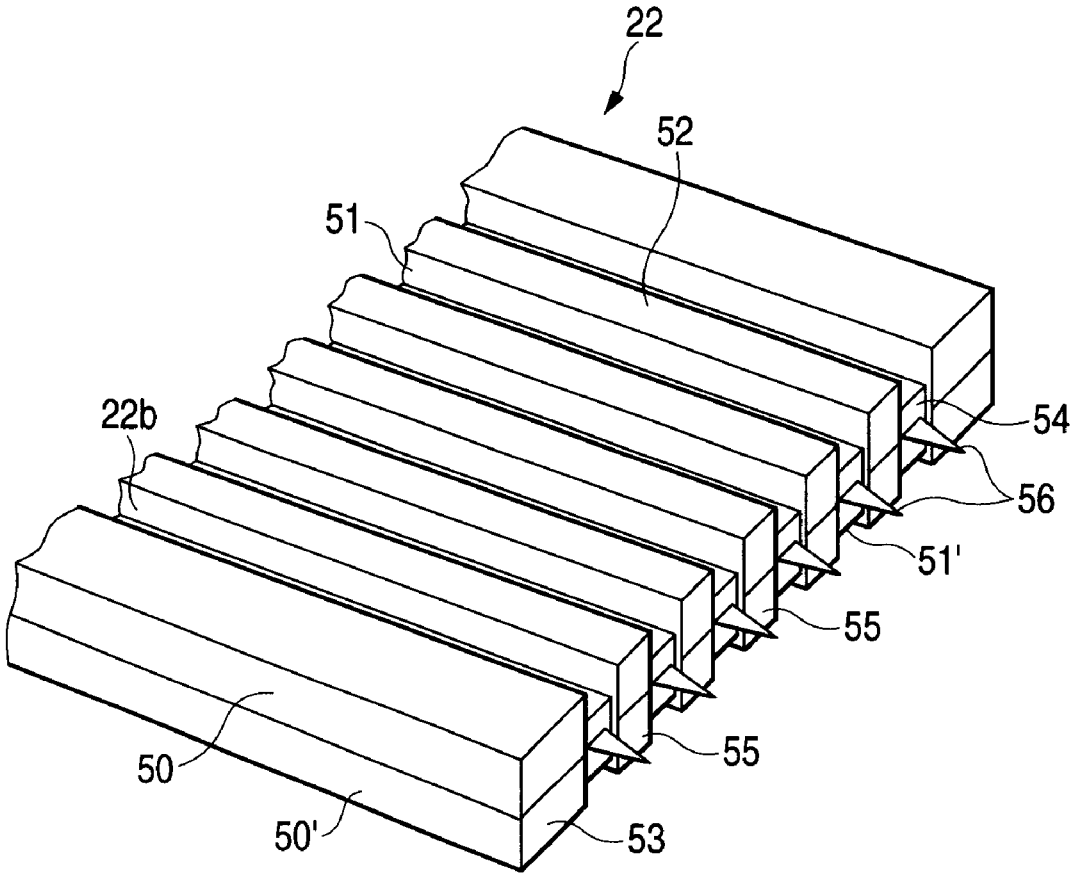
[FIG. 9]
Figure 10:
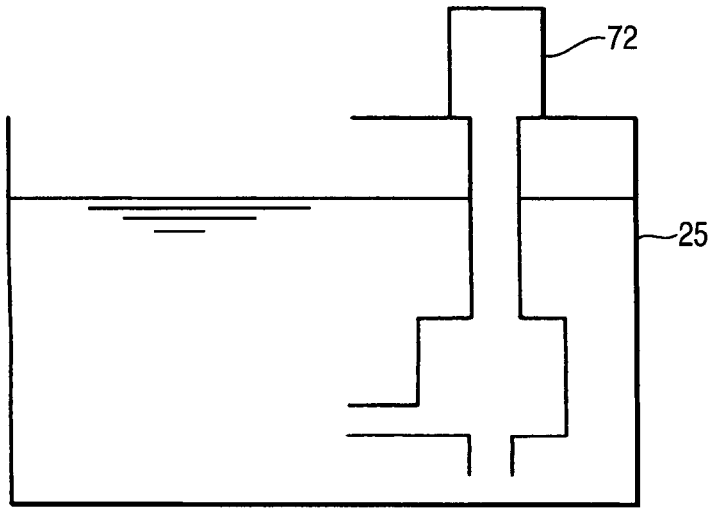
[FIG. 10]
Figure 11:
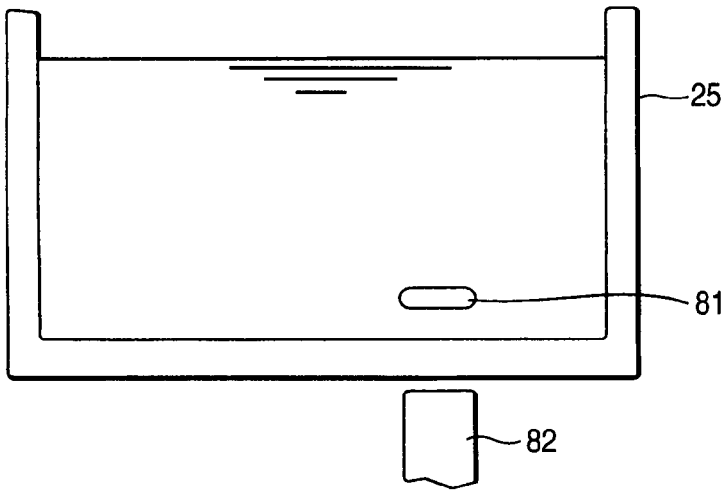
[FIG. 11]

Still another example of the ejecting head is described with reference to FIG. 9. As is illustrated in FIG. 9, ejecting head 22 has a pair of supporting members 50 and 50' made of substantially rectangular boards of plastic, glass or ceramic with a 1 to 10 mm thickness. On one side of each board are formed plural rectangular slots 51 and 51' (not shown in the figure) running parallel to each other with spacings corresponding to the recording resolution. Each slot 51 or 51' is preferably 10 to 200 μm wide and 10 to 300 μm deep, and in each slot, ejecting electrode 22*b* is formed that covers the surface of the slot entirely or partly. By forming plural slots 51 and 51' on one surface of supporting members 50 and 50', plural dividing walls 52 result between each slot 51. Supporting members 50 and 50' are bonded together at the surfaces opposite to the planes on which the slots were formed. As a result, on its outer surface, ejecting head 22 has slots 51 and 51' through which ink flows. Slots 51 and 51' provided on each supporting member 50 or 50' are connected together in one-to-one relationship via upper end 53 of ejecting head 22. And rectangular part 54 where the two slots are connected is recessed from upper end 53 of ejecting head 22 by a predetermined distance (50 to 500 μm). In other words, on both sides of each rectangular part 54, there is provided upper end 55 of each dividing wall 52 of each supporting member 50 or 50' in such a manner that the upper end 55 protrudes rectangular part 54. And, from each rectangular part 54, guiding projection 56 made of an insulating material such as those described previously protrudes to form an ejecting point. When an ink is circulated in ejecting head 22 thus constructed, the ink is fed to rectangular end 54 through each slot 51 provided on the outer surface of supporting member 50, and discharged out via each lower slot 51' formed in supporting member 50' arranged in the opposite side. To facilitate a smooth ink flow, ejecting head 22 is slanted by a pre-determined angle so that the feeding side (supporting member 50) be located upward relative to the discharge side (supporting member 50'). When the ink is circulated in this way, the ink passing each rectangular end 54 wets upward along each projection 56 forming an ink meniscus in the vicinity of rectangular end 54 and projection 56. Under the state wherein an independent ink meniscus is formed at each rectangular end 54 with the application of voltage on ejecting electrode 22*b* according to the image data relative to the imaging drum (not shown in the figure) holding a printing medium thereon and arranged to face the ejecting point, the ink is ejected from the ejecting points and an image is formed on the printing medium. Alternatively, ink can be compulsorily circulated by forming a cover sealing the slots formed on the outer surfaces of supporting members 50 and 50', thus forming a pipe-formed ink flow channel. In this construction, ejecting head 22 need not be slanted.

Head 22 described using FIGS. 3 to 9 can have a maintenance part such as head-cleaning means if necessary. For example, when a suspension period lasts, or when anything unusual on image quality takes place, a desirable condition can be restored by using the means of wiping the tip of the ejecting head with a soft brush or cloth, circulating a pure ink solvent only, or sucking the head along with the feed or circulation of an ink solvent, individually or in combination. Additionally, to prevent ink solidification, it is effective to keep the head in a cover filled with the vapor of an ink solvent, or cool the head to suppress the vaporization of the ink solvent. In the case where the head is contaminated seriously, it is effective to compulsorily suck the ink from the ejecting point, compulsorily introduce air, ink or the jet of an ink solvent from the ink flow channel, or apply ultrasonic wave to the head immersed in an ink solvent, etc. These methods may be used individually or in combination.

Now, the prevention of ink aggregation and/or precipitation and/or the redispersion of ink will be described. When ink in an ink tank stays stationary due to the suspension of ink-flow and the ink particles therein aggregate and/or precipitate, pipe choking or head choking takes place leading to unstable ink ejection. To prevent such choking problems, a homogeneously dispersed state of the ink particles is again restored by preventing the aggregation and/or precipitation and/or redispersing the aggregate or precipitate by one of the actions of agitation, dispersion, mixing or jetting. Each action may be applied individually or in combination depending on the volume as well as the type of ink. Further, the action may be applied at any timing, with a fixed interval or continuously. Although a aggregation and/or precipitation-preventing member and/or a redispersing member arranged at the upstream side of the ink ejecting part can supply homogeneously dispersed ink particles to the ink ejecting part, it is more effective to provide a tubular agitator such as a pipeline mixer or in-line mixer just in front of the ink ejecting part. In cases where the ink is driven to flow after a suspension of ink-flow, it is effective that the aggregation and/or precipitation-preventing member and/or the redispersing members should be activated prior to the start of ink-flow to prevent the aggregates or precipitates from being fed to the ink ejecting part. Further, by providing a cartridge-type aggregation and/or precipitation-preventing member and/or redispersing member interchangeably in the ink-flow path, it becomes possible to select the most proper aggregation and/or precipitation-preventing member and/or redispersing member differing in aggregation and/or precipitation-preventing and/or redispersing action depending on ink volume or type. At the same time, maintainability improves.

Specific examples of the aggregation and/or precipitation-preventing member and/or redispersing member which exhibits an agitating action include an stirrer equipped with disk- or fan-shaped agitating blades rotating at 1 to 3,000 rpm, a homo-mixer which comprises a turbine of special shape capable of rotating at a high speed and a stator having a radial baffle, and agitates aggregates and the like by making use of ink ejection under the pressure difference between the bottom and the upper part of the turbine caused by the high-speed rotation thereof, a pipeline mixer which agitates aggregates and the like by the rotation of agitating wings arranged in an ink-flow path, a magnetic mixer (exemplified by the magnetic mixers and star-head stirrer both manufactured by Tokai Riki Co., Ltd.), an ultra-vibrating blender which agitates and disperse aggregates by ultrasonic vibration, and a lamond stirrer (made by Tokai Riki Co., Ltd.) which comprises two disks each having honeycomb walls, sucks ink from the axial center of the bottom plane along with disk rotation and agitates ink by expelling ink overflowing the honeycomb walls at the side plane.

As the devices that exert a dispersing action, one can mention a homogenizer in which aggregates are dispersed by the rotation of agitating blades (made by Nippon Seiki Manufacturing Co., Ltd.), an ultrasonic homogenizer which disperses aggregates via ultrasonic vibration (made by Nippon Seiki Manufacturing Co., Ltd.), an ultrasonic filtering machine which disperses aggregates by rapidly vibrating a filter plane (made by Ginsen Co., Ltd.), a high-speed disperser (KD mill), an ultrasonic cleaning machine (made by Nippon Seiki Manufacturing Co., Ltd.), and an ultra-vibration stirrer (Ultra-vibrating α-stirrer made by Nihon Techno Co., Ltd.).

As the devices that exert a mixing action, one can mention a mixing pump enabling homogenization by the function of mixing two liquids (made by Nippon Ball Valve Co., Ltd.), and an inline mixer which mixes ink with plural mixing wings attached to the rotating axis of a vessel (exemplified by Dynamic Mixer made by Nippon Ball Valve Co., Ltd.).

Further, as the devices that exert a mixing action, one can mention an underwater pump (made by Rei-Sea Co., Ltd.).

Each of those devices cited above is preferably employed for the invention in an arbitrarily miniaturized or modified form. These aggregation and/or precipitation-preventing members and/or redispersing members exhibit a single mode of action such as agitation and mixing, but sometimes exhibit plural actions to effectively conduct aggregation and/or precipitation-preventing and/or redispersion.

FIGS. 15 to 20 are schematic diagrams each showing the constitution of a printing apparatus equipped with inkjet image recording apparatus 3 in which an aggregation and/or precipitation-preventing member and/or redispersing member is installed. However, the scope of the invention is not limited to the following constitutional examples.

FIGS. 15 to 20 are schematic diagrams each showing the constitution of a printing apparatus for performing printing by moving a printing medium along with the rotation of a counter drum according to the invention.

Figure 15:
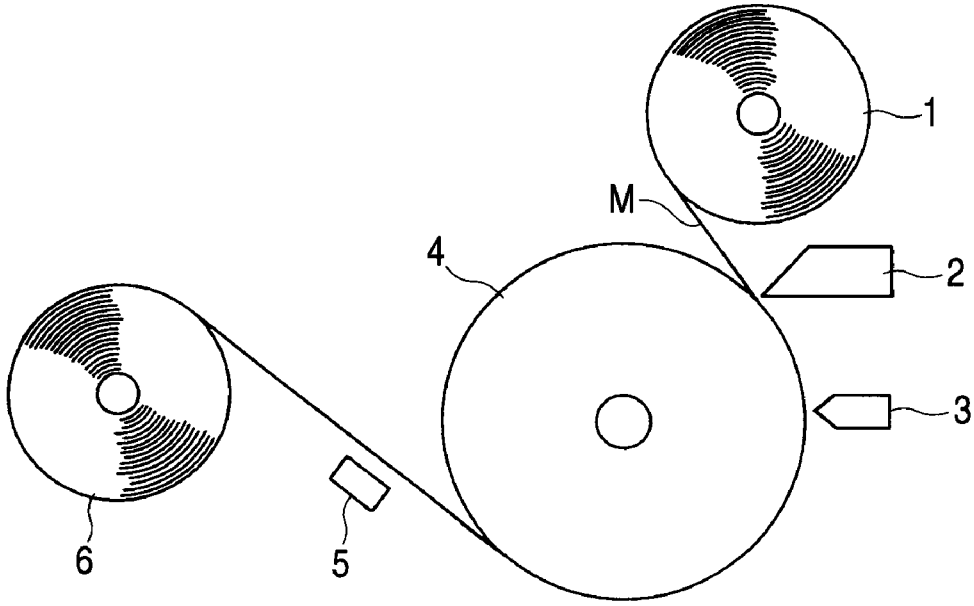
[FIG. 15]
Figure 16:
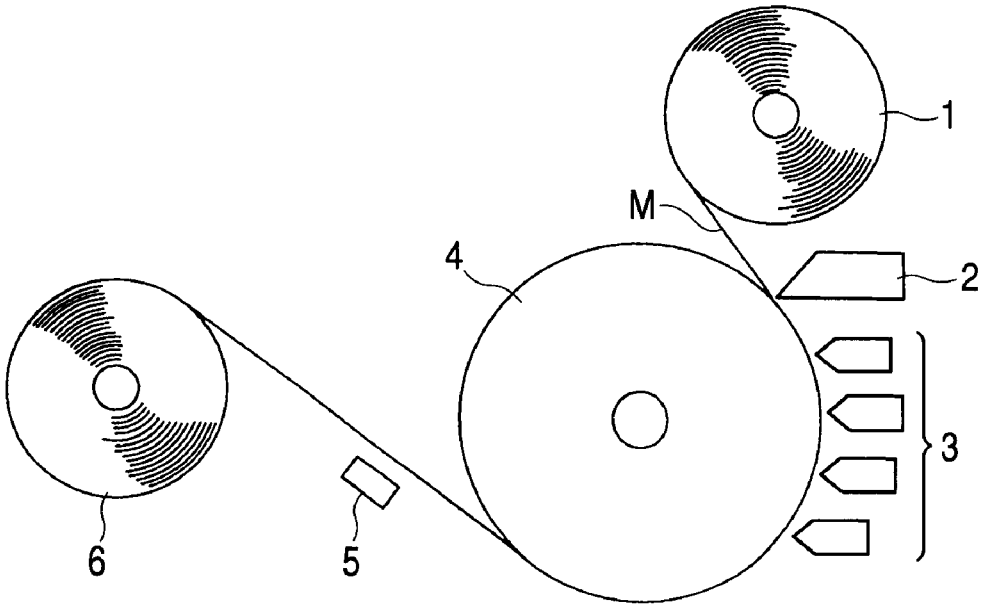
[FIG. 16]
Figure 17:
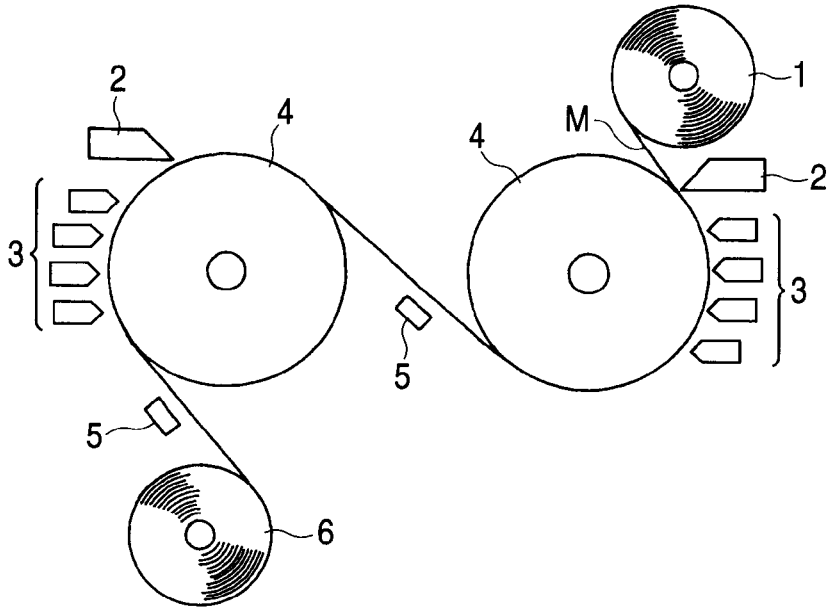
[FIG. 17]
Figure 18:
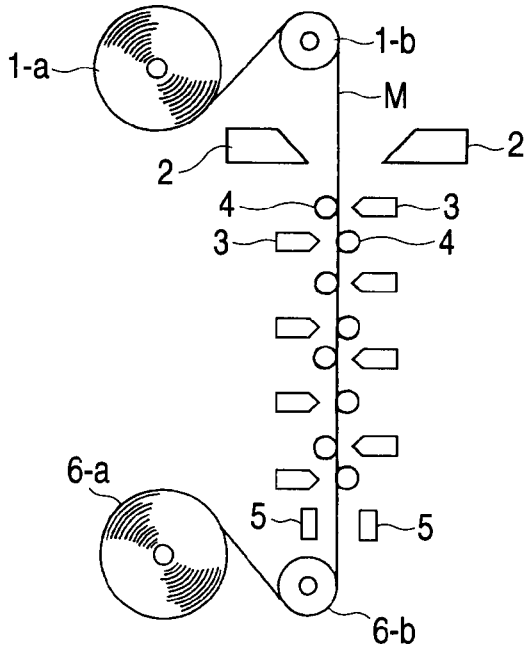
[FIG. 18]

FIGS. 15 to 18 are schematic diagrams each showing the constitution of a web-type printing apparatus in which a roll of a printing medium is stretched by means of a counter drum, a printing medium-feeding roll and a printing medium-winding roll or a guide roll. FIG. 15 is a diagram showing a web-type printing apparatus for performing a single-sided, monochromatic printing, FIG. 16 is one for performing single-sided four-color printing, and FIGS. 17 and 18 are ones for performing double-sided four-color printing.

Figure 19:
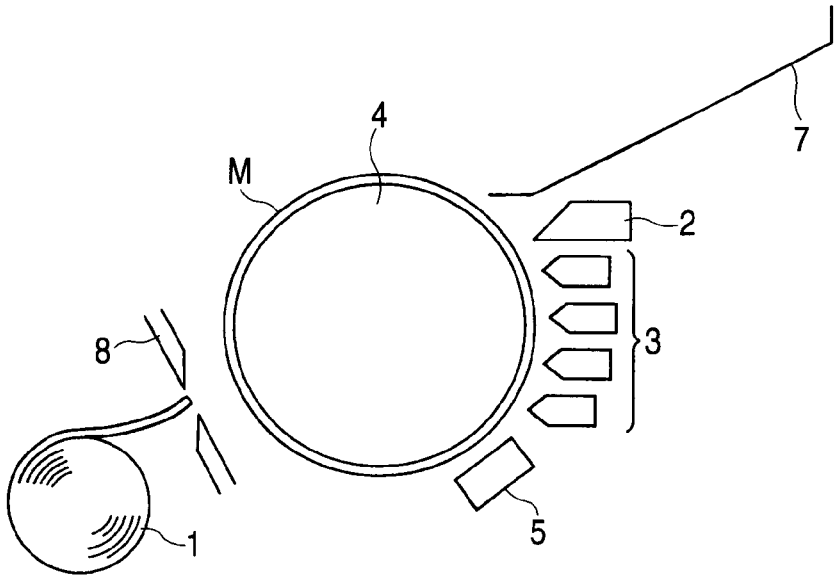
[FIG. 19]
Figure 20:
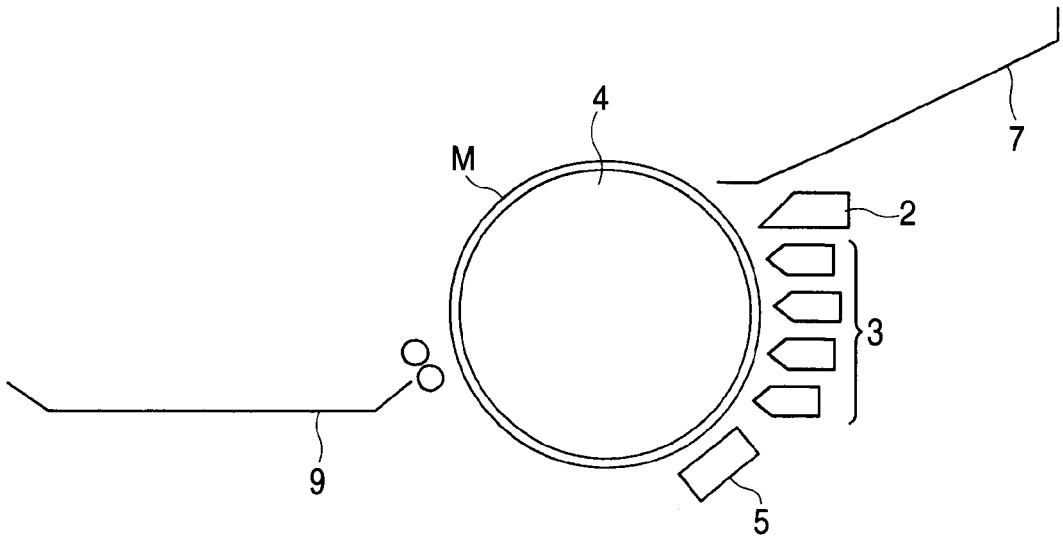
[FIG. 20]

Further, FIG. 19 is a schematic diagram showing a single-sided four color printing apparatus in which a roll of a printing medium is cut into sheets, the resulting sheets being wound around a counter drum, and FIG. 20 is one showing a printing apparatus using a sheet-formed printing medium.

Figure 21:
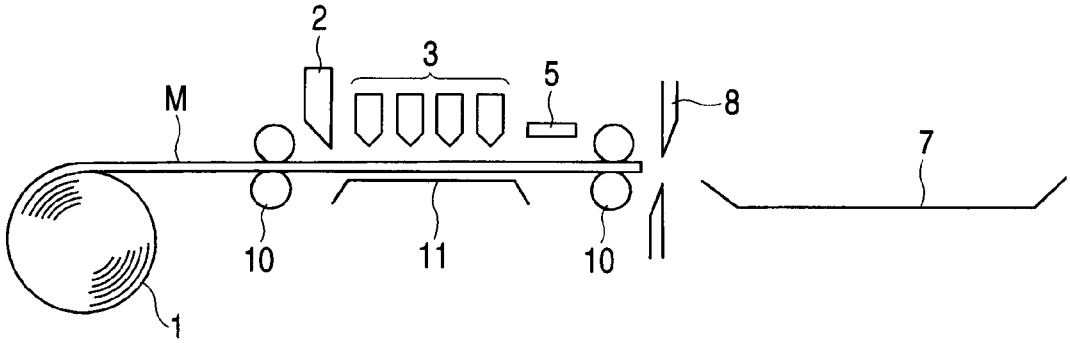
[FIG. 21]
Figure 22:
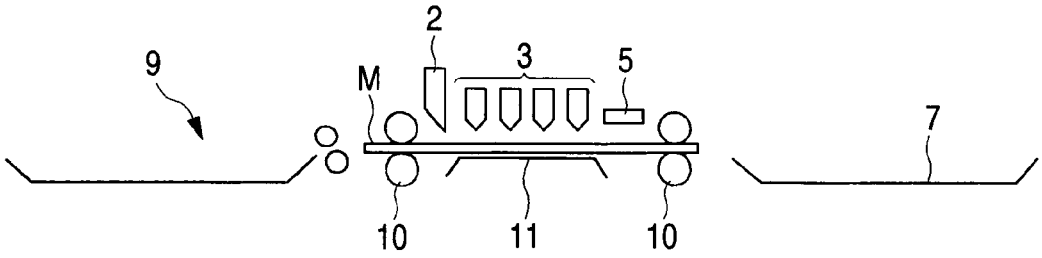
[FIG. 22]

On the other hand, FIGS. 21 and 22 are schematic diagrams each showing the constitution of a printing apparatus for performing printing by holding and conveying a printing medium with a pair of capstan rollers according to the invention. FIG. 21 is a schematic diagram showing a printing apparatus using a roll of a printing medium while FIG. 22 schematically shows the constitution of a printing apparatus using a sheet-formed recording medium.

In the first place, the printing process according to the invention is described with reference to the diagram of the printing apparatus for performing single-sided monochromatic printing on a rolled printing medium shown in FIG. 15.

The inkjet printing apparatus shown in FIG. 15 (hereinafter sometimes referred to as "printing apparatus", too) comprises rolled printing medium-feeding roll 1, dust and paper powder-eliminating member 2, inkjet image recording unit 3, counter (imaging) drum 4 arranged at the position facing image recording unit 3 with a printing medium therebetween, fixing unit 5 and printing medium-winding roll 6.

After the removal of dusts and the like on the printing medium delivered from the printing medium-feeding roll by means of dust and paper powder-removing member 2, an ink is imagewise ejected from the ink-ejecting head (described later) of imaging unit 3 onto the printing medium on imaging drum 4, thus a printing image is recorded. After the image is fixed on the printing medium by fixing member 5, the printing medium which finished printing is wound round printing medium-winding roll 6.

Counter (imaging) drum 4 is comprised of a metallic roll, a roll having an electrically conductive rubber layer on the surface, or an insulating drum made of, e.g., plastic, glass or ceramic, having a metallic layer on the surface thereof provided by vapor deposition or metal plating so as to act as the counter electrode to the inkjet electrode of the ejecting head. Thus, an effective electric field can be formed between counter (imaging) drum 4 and the ink-ejecting part of imaging unit 3. It is also effective to provide a heating member on imaging drum 4 and elevate the temperature of the drum for the improvement of image quality. As the fixing of the ejected ink droplets on the printing medium is accelerated by this measure, blur is further restrained.

Further, the physical properties of the ejected ink droplets on the printing medium are controlled by making the drum temperature constant, leading to consistent and uniform dot formation. For making drum temperature constant, it is more preferred to provide a cooling means, too.

As the method of eliminating dusts and paper powders, a non-contacting one such as suction removal, blow-off removal or electrostatic removal, and a contacting one using a brush or roller can be used.

In the present invention, air suction, blow-off by air or a combination of them is used.

The printing medium M fed out of printing medium-feeding roll 1 is given tension by driving printing medium-winding roll 6, and brought into contact with imaging (counter) drum 4, by which inkjet imaging unit 3 is prevented from damaging by accidental contact with the vibrating printing medium web during imaging.

Alternatively, it is possible to prevent printing medium M from touching inkjet imaging unit 3 by arranging members that bring the printing medium into close contact with the imaging (counter) drum 4 only at a close vicinity of the imaging position of the inkjet recording unit and actuating these members at least when imaging is conducted. Specifically, for example, pressing rollers may be arranged at the upstream and downstream sides of the imaging position on the drum. Specifically, pressing rollers, guides, electrostatic adsorption, etc. are effectively used.

The oily ink image thus formed is enhanced with fixing unit 5. Image fixing can be performed by various methods known in the art such as heat fixing or solvent fixing. As heat fixing, irradiation with an infrared lamp, a halogen lamp or a xenon flash lamp, hot air fixing with a heater or heat roll fixing is usually employed. Flush fixing with use of a xenon lamp is well known as a fixing method for electrophotographic toner images and has an advantage of completing fixing in a short period. When a laminated paper is used, a rapid temperature rise promotes an abrupt moisture vaporization to form unevenness in the paper surface, which phenomenon is often called blistering. Thus, it is preferred for blister prevention to elevate the temperature of the paper gradually by using multiple fixing members whereby the distance from each member to the printing medium or the power supplied to each member is properly changed.

In solvent fixing, a solvent such as methanol and ethyl acetate that can dissolve the resinous ingredient in the ink is sprayed or the medium is exposed to the vapor of such a solvent, and the excessive solvent vapor is collected.

It is desirable to keep the image formed on the printing medium not brought into contact with anything after the oily ink image formation with ejecting head 22 until the step of image fixing with fixing unit 5.

FIGS. 16 to 18 are diagrams each showing the constitutional example of a single- or two-sided four-color printing apparatus.

Since the operating principle thereof is readily understood by the description on the single-sided monochromatic printing apparatus cited hereinabove, further explanation will be omitted. Though in the specification a four-color printing apparatus is shown, the number of colors need not be limited to 4, but optionally chosen depending on need.

FIGS. 19 and 20 illustrate other constitutions according to the invention, and explains a printing apparatus in which an automatic paper-exhausting member 7 is equipped with use of a printing medium M wound around a counter drum 4. FIG. 20 illustrates a constitutional example of an apparatus equipped with automatic paper-feeding member 9 with use of a sheet-formed printing medium. In the following, the example illustrated in FIG. 19 that uses a roll of a printing medium M is described.

In the first place, printing medium M is drawn from printing medium-feeding roll 1, and then loaded onto counter drum 4 after cut to an arbitrary length by means of cutter 8 whereby the printing medium is contacted and fixed to the drum with mechanical means such as leading edge/trailing edge grippers or an air suction device, or electrostatic means to prevent the trailing edge of the medium from flapping to touch inkjet imaging unit 3 during imaging.

Alternatively, it is possible to prevent printing medium M from touching inkjet recording unit 3 by arranging a member that brings the printing medium into contact with drum 4 only near the imaging position of the inkjet imaging unit and by actuating the member at least during imaging. Specifically, for example, pressing rollers may be arranged at the upstream and downstream sides of the imaging position.

Further it is desirable to keep the head apart from printing medium M when image recording is not performed, by which the inkjet imaging unit is effectively prevented from damaging by the contact with the medium.

Inkjet head 22 (shown in FIG. 1) may comprise a single channel head, multi-channel heads or full line heads, and main scanning is performed by the rotation of counter drum 4. When the inkjet head comprises multi-channel heads having a plurality of ink-ejecting parts, the ink-ejecting parts are arranged in parallel to the axis of counter drum 4.

Further, when a single channel head or multi-channel type head is used, image data processing-control unit 21 moves head 22 parallel to the axial direction of the counter drum continuously or stepwise, and an oily ink is ejected onto printing medium M loaded on drum 4 on the basis of the ejection position and the dot coverage obtained by the calculation of image data processing-control unit 21. In this way, a dot image is formed on printing medium M with the oily ink corresponding to the density distribution of the original. This action continues until a predetermined ink image completes on printing medium M.

On the other hand, when ink-recording head 22 comprises full line heads having a length substantially equal to the width of the drum, a single drum rotation is enough to complete the formation of an oily ink image on printing medium M, thus giving a printed matter. By performing main scanning by drum rotation, one can improve the positional accuracy along the main scanning direction with high image recording speeds. The printing medium M thus printed is subjected to fixation by fixing unit 5 and discharged by automatic exhausting unit 7.

Heretofore, constitutional examples of the printing apparatus performing single-sided four-color printing have been shown, but the invention is not limited thereto; the number of color and the adoption of single-sided or double-sided printing depend on necessity, and the constitutions of the printing apparatus may be optionally selected.

On the other hand, FIGS. 21 and 22 are schematic diagrams each showing the constitution of a printing apparatus performing imaging by conveying a printing medium inserted between a pair of capstan rollers according to the invention. FIG. 21 is a schematic diagram showing a printing apparatus using rolled printing medium M, and FIG. 22 is one showing a printing apparatus using sheet-formed recording medium M.

The overall constitution of the printing apparatus performing single-sided four-color printing on a rolled printing medium shown in FIG. 21 is explained below. Printing medium M is conveyed by being inserted between each of two pairs of capstan rollers 10, and imaged by inkjet imaging unit 3 on the basis of the data of proper pixel numbers and gradation numbers obtained by digitizing calculation of image data processing-controlling unit (21 in FIG. 1). At the position where imaging by inkjet imaging unit 3 is performed, it is preferred to provide the part forming the position with earth member 11 so that the part can serve as the counter electrode for the ejecting head electrode during electrostatic ink ejection.

In FIG. 21, sheet cutter 8 is provided at the upstream side of automatic exhausting unit 7 to cut rolled printing medium M. Sheet cutter 8 may be located at any position.

Next, the process of producing printed matters with the printing apparatus of the invention will be explained in further detail with reference to FIG. 21.

In the first place, a printing medium is conveyed by capstan rollers 10. If necessary, there may be provided a printing medium guide member not shown in the figure, with which inkjet imaging unit 3 is prevented from damaging caused by flapping of the leading or trailing edge of the medium. Alternatively, the printing medium can also be prevented from touching the inkjet imaging unit by arranging a member for not loosening the printing medium only in the vicinity of the imaging position of the inkjet imaging unit, and actuating this member at least during imaging. Specifically, for example, there is a method of arranging pressing rollers at the upstream and downstream sides of the imaging position.

Further it is desirable to keep the head apart from printing medium M when imaging is not conducted, by which inkjet imaging unit 3 is effectively prevented from damaging by the contact with the medium.

The image data from the magnetic disc unit and the like are given to image data processing-controlling unit 21 in FIG. 1. Image data processing-controlling unit 21 calculates the ejecting position of an oily ink and the dot coverage at that position in accordance with the input image data. These processed data are once stored in a buffer.

Image data processing-controlling unit 21 regulates the movement of inkjet head 22, the ejecting timing of the oily ink, the operating timing of the capstan rollers, and further, depending on need, brings ejecting head 22 to a position close to the printing medium by head distancing/approximating mechanism 31 (shown in FIG. 1). The spacing between inkjet head 22 and the surface of the printing medium is kept at a pre-determined value during imaging by mechanical distance control such as with a knocking roller or by the control of the head distancing/approximating mechanism by the signals from an optical distance detector. By such spacing control, dot diameter does not fluctuate due to floating of the printing medium or vibrations given to the printing apparatus, thus achieving a desirable printing.

Inkjet head 22 may comprise a single channel head, multi-channel heads or full line heads, and sub-scanning is performed by moving printing medium M. When the inkjet head comprises multi-channel heads having a plurality of ink-ejecting parts, the ink-ejecting parts are arranged in parallel or almost parallel to the conveyance direction of printing medium M. Further, when a single channel head or multi-channel type head is used, image data processing-controlling unit 21 moves head 22 orthogonally to the conveyance direction of printing medium M, and an oily ink is ejected on the basis of the ejection position and the dot coverage obtained by the calculation of image data processing-controlling unit 21. In this way, a dot image is formed on printing medium M with the oily ink corresponding to the density distribution of the original. This action continues until a predetermined ink image completes on printing medium M. On the other hand, when ink-ejecting head 22 comprises full line heads having a length substantially equal to the width of the drum, the ejecting parts are arranged in orthogonal or almost orthogonal direction to the conveyance direction of printing medium M, and an oily ink image is formed as printing medium M passes the imaging unit. Printing medium M thus printed is subjected to fixation by fixing unit 5 and exhausted by the automatic exhausting unit.

Although the constitutional example of a single-sided four-color printing apparatus has been described here, the scope of the invention is not restricted to the example, but the number of color and whether a single- or double-side printing is adopted are determined depending on the need in concern.

Printing media M for use in the invention will be described in the following.

As the printing media, high quality bond papers, light weight-coated papers and coated papers, all being generally used as ordinary printing stocks can be used. Papers having a resinous film layer on the surface such as, for example, polyolefin-laminated papers, and plastic films such as, for example, polyester films, polystyrene films, vinyl chloride-based films, and polyolefin films can also be used. Further, plastic films and processed papers which have a metal layer deposited on the surface or a laminated metal foil can also be used. Self-evidently, dedicated inkjet printing paper or film can be used, too.

The oily ink used in the invention will be explained in the following.

The oily ink used in the invention comprises at least colored particles dispersed in a nonaqueous solvent that has a specific resistance not lower than $10^9$ Ωcm and a dielectric constant not exceeding 3.5.

The nonaqueous solvent having a specific resistance not lower than $10^9$ Ωcm and a dielectric constant not exceeding 3.5 used in the invention preferably includes straight or branched chain aliphatic hydrocarbons, alicyclic or aromatic hydrocarbons, and halogen-substituted derivatives of these hydrocarbons. Some examples are hexane, heptane, octane, isooctane, decane, isodecane, decaline, nonane, dodecane, indodecane, cyclohexane, cyclooctane, cyclodecane, benzene, toluene, xylene, mesitylene, Isopar C, Isopar E, Isopar G, Isopar H, Isopar L (Isopar is a trade name of EXXON Co.), Shellsol 70, Shellsol 71 (Shellsol is a trade name of Shell Oil Co.), Amsco OMS and Amsco 460 solvents (Amsco is a trade name of Spirits Co.) and silicone oil. They are used individually or as mixtures. The upper limit of the specific resistance of these nonaqueous solvents is about $10^{16}$ Ωcm, and that of the dielectric constants is about 1.9.

The reason why the electric resistance of the nonaqueous solvent used in the invention is restricted to the above-cited range is that when the resistance is below the lower limit of the preferable range mentioned above, the colored particles will not concentrate, thus forming recorded dots with a low density or a faint color and blur. And the reason why the dielectric constant is limited to the range cited above comes from the fact that, when the dielectric constant becomes too high, too much a relaxation of electric field takes place due to the polarization of the solvent, making ink ejection difficult.

As for the colored particles to be dispersed in the nonaqueous solvent enumerated above, a colorant itself may be dispersed in the form of finely divided particles, or may be included in dispersed resin particles that act to improve the fixing property of the particles. In the latter case, a pigment is usually covered with a resinous material to prepare resin-coated particles, and a dye is used to color dispersed resin particles to give rise to colored particles.

As suitable colorants, the pigments and dyes that have been conventionally used in oily ink compositions or in liquid developers for electrostatic photography can be used.

Inorganic or organic pigments that have been widely used in graphic arts can be applied. Specifically, for example, carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacrydone pigments, isoindolinone pigments, dioxazine pigments, indanthrene pigments, perylene pigments, perinone pigments, thioindigo pigments, quinophthalone pigments and metal complex pigments, which are all well known in the art, can be used without any particular restriction.

Suitable dyes include oil-soluble ones such as azo dyes, metal complex salt dyes, naphthol dyes, anthraquinone dyes, indigo dyes, carbonium dyes, quinonimine dyes, xanthene dyes, aniline dyes, quinoline dyes, nitro dyes, nitroso dyes, benzoquinone dyes, naphthoquinone dyes, phthalocyanine dyes and metal phthalocyanine dyes.

Each of these pigments and dyestuffs can be used individually or in a proper combination thereof. A preferable range of the content is from 0.5 to 5% by weight of the total ink quantity.

In the oily ink used for the invention, it is preferred to incorporate, in addition to the above-described colored particles, dispersed resinous particles for the purpose of improving the fixing property of printed images.

As the particulate resin dispersed in the nonaqueous solvent described above, resinous particles which are solid at temperatures not exceeding 35° C., and have a sufficient affinity to nonaqueous solvents can be used. Moreover, resins (P) having a glass transition temperature ranging from −5° C. to 110° C., or a softening point ranging from 33° C. to 140° C. are desirable. More preferably, those with a between 10° C. and 100° C., or with a softening point between 38° C. and 120° C. are used. Still more preferably, glass transition temperature should be from 15° C. to 80° C., or the softening point from 38° C. to 100° C.

By using those resins which have such a glass transition temperature or a softening point, the affinity of the surface of the printing medium for the particulate resin increases, and at the same time, the binding force among the resin particles present on the printing medium become intense. Accordingly, a strong adhesion of the image area to the surface of the printing medium and hence an improved smear resistance are achieved. With resins of a glass transition temperature or softening point outside the preferred range cited above, the affinity between the surface of the printing medium and the resin particles decreases or the bondage among the resin particles becomes insufficiently weak.

The weight-averaged molecular weight Mw of the resin (P) is from $1\times10^3$ to $1\times10^6$, preferably from $5\times10^3$ to $8\times10^5$ and more preferably from $1\times10^4$ to $5\times10^5$.

Practical examples for such resins (P) include olefinic polymers and copolymers (for example, polyethylene, polypropyrene, polyisobutyrene, ethylene-vinyl acetate copolymers, ethylene-acrylate copolymers, ethylene-methacrylate copolymers and ethylene-methacrylic acid copolymers), vinyl chloride polymers and copolymers (for example, poly (vinyl chloride) and vinyl chloride-vinyl acetate copolymers), vinylidene chloride copolymers, polymers and copolymers of vinyl alkanoate, polymers and copolymers of allyl alkanoate, polymers and copolymers of styrene or styrene derivatives (for example, butadiene-styrene copolymers, isoprene-styrene copolymers, styrene-methacrylate copolymers and styrene-acrylate copolymers), acrylonitrile copolymers, methacrylonitrile copolymers, alkyl vinyl ether copolymers, polymers and copolymers of acrylic acid esters, polymers and copolymers of methacrylic acid esters, polymers and copolymers of itaconic acid diesters, maleic anhydride copolymers, acrylamide copolymers, methacrylamide copolymers, phenol resins, alkyd resins, polycarbonate resins, ketone resins, polyester resins, silicone resins, amide resins, hydroxy and carboxyl group-modified polyester resins, butyral resins, poly (vinyl acetal) resins, urethane resins, rosin-based resins, hydrogenated rosin-based resins, petroleum resins, hydrogenated petroleum resins, maleic acid resins, terpene resins, hydrogenated terpene resins, coumarone-indene resins, cyclized rubber-methacrylate copolymers, cyclized rubber-acrylate copolymers, copolymers containing a nitrogen-free heterocycle (examples of such rings being furan, tetrahydrofuran, thiophene, dioxane, dioxofuran, lactone, benzofuran, benzothiophene and 1,3-dioxetane rings), and epoxy resins.

The total content of the colored particles together with the particulate resin dispersed in the oily ink of the invention preferably lies in the range of from 0.5 to 20% by weight based on the total ink quantity. Contents below the cited range tend to cause various problems such as forming an printed image with an insufficient image density, failing in obtaining tough images due to the lack of the affinity between the ink and the surface of the printing medium, etc. On the other hand, with contents above the cited range, a homogeneous dispersion becomes difficult to prepare, or sometimes an uneven ink-flow takes place within the ejecting head, thus hindering a consistent ink ejection.

The average particle size of the colored particles and the particulate resin dispersed in the nonaqueous solvent is preferably 0.05 to 5 μm, more preferably 0.1 to 1.5 μm, and still more preferably 0.4 to 1.0 μm. These particle sizes were determined with CAPA-500 (a trade name of a product manufactured by Horiba, Ltd.).

The colored particles dispersed in the nonaqueous solvents used in the invention can be prepared by conventional mechanical grinding or particle-forming polymerization processes conventionally known in the art. As a typical mechanical method, all the ingredients for the particulate resin are mixed, melted and then blended, followed by direct grinding with a known grinder depending on necessity, and the obtained fine particles are further dispersed, with the aid of a polymer dispersant, by means of a wet-type dispersing machine (e.g., a ball mill, paint shaker, KD mill or Dyno mill). Another method comprises first preparing a mixture comprising all the colorants for the colored particle and an auxiliary polymer dispersant (or a polymer for coating), then finely dividing the mixture, and finally performing a further dispersion in the presence of a polymer dispersant. Specifically, the methods adopted for the preparation of a paint or an electrophotographic liquid toner can be applied, and detailed descriptions on those products are found in, for example, *Toryo no Ryudo to Ganryo Bunsan* (Paint Flow and Pigment Dispersion), supervised and translated by Kenji Ueki (Kyoritsu Shuppan Publishers Co., 1971), *Toryo no Kagaku* (Paint Science) authored by Solomon (Hirokawa Shoten Co., 1969), *Paint and Surface Coating Theory and Practice, Kohtingu Kogaku* (Coating Engineering) (Asakura Shoten, 1971) and *Kohtingu no Kiso Kagaku* (Basic Science of Coating) (Maki Shoten, 1977), both authored by Yuji Harasaki.

There is also a method of preparing colored particles by coloring resinous particles formed by a particle-forming polymerization method. As such particle-forming polymerization methods, dispersion polymerization in nonaqueous systems is well known. Related descriptions are found in Chapter 2 of *Cho-biryuusi Porima no Saishin Gijyutsu* (Latest Technologies of Ultra-fine Polymers), supervised by Souichi Muroi (CMC Shuppan, 1991), Chapter 3 of *Saikin no Denshi-shasin Genzo Sisutemu to Tonah Zairyo no Kaihatsu Jitsuyoka* (Recent Electrophotographic Developing Systems and Development of Toner Materials) written by Koichi Nakamura (Nihon Kagaku Joho Co., 1985), and *Dispersion Polymerization in Organic Media,* written by K. E. J. Barrett (John Wiley, 1975).

Usually, in order to stably disperse a particulate resin in a nonaqueous solvent, a polymer dispersant is used. Such a polymer dispersant consists, as its principal component, of a recurring unit that is soluble in the nonaqueous solvent, and preferably has a weight-averaged molecular weight Mw of from $1\times10^3$ to $1\times10^6$, more preferably from $5\times10^3$ to $5\times10^5$.

Some preferable examples for such a recurring unit for the dispersed polymer include the polymerization component represented by the following formula (I).

Formula (I)

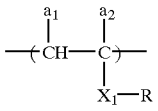

In Formula (I), $X_1$ represents —COO—, —OCO— or —O—.

R represents an alkyl group or an alkenyl group of 10 to 32 carbon atoms, more preferably those of 10 to 22 carbon atoms, and they may have a straight chain or branched structure. Though unsubstituted groups are preferred, they may have a substituent.

Specific groups include decyl, dodecyl, tridecyl, tetradecyl, hexadecyl, octadecyl, eicosanyl, docosanyl, decenyl, dodecenyl, tridecenyl, hexadecenyl, octadecenyl, and linolenyl.

In the formula, $a_1$ and $a_2$ may be the same or different, representing a hydrogen atom, a halogen atom (e.g., chlorine atom or bromine atom), a cyano group, an alkyl group of 1 to 3 carbon atoms (e.g., methyl, ethyl or propyl), —COO—$Z_1$, or —$CH_2$COO—$Z_1$ [$Z_1$ represents a hydrocarbon group containing carbon atoms not more than 22 such as alkyl, alkenyl, aralkyl, alicyclic and aryl].

Among the hydrocarbon group represents by $Z_1$, preferable examples include the following: an alkyl group of 1 to 22 carbon atoms that may be substituted (e.g., methyl, ethyl, propyl, butyl, heptyl, hexyl, octyl, nonyl, decyl, dodecyl, tridecyl, teteradecyl, hexadecyl, octadecyl, eicosanyl, docosanyl, 2-chloroethyl, 2-bromoethyl, 2-cyanoethyl, 2-methoxycarbonylethyl, 2-methoxyethyl and 3-bromopropyl), an alkenyl group of 4 to 18 carbon atoms that may be substituted (e.g., 2-methyl-1-propenyl, 2-butenyl, 2-pentenyl, 3-methyl-2-pentenyl, 1-pentenyl, 1-hexenyl, 2-hexenyl, 4-methyl-2-hexenyl, decenyl, dodecenyl, tridecenyl, hexadecenyl, octadecenyl and linolenyl), an aralkyl group of 7 to 22 carbon atomes that maybe substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl and dimethoxybenzyl), an alicyclic group of 5 to 8 carbon atoms that may be substituted (e.g., cyclohexyl, 2-cyclohexylethyl and 2-cyclopentylethyl), or an aromatic group of 6 to 12 carbon atoms that may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chloropheyl, dichlorophenyl, bromophenyl, cyanophenyl, acetylphenyl, methoxycarbonylphenyl, ethoxycarbonylphenyl, butoxycarbonylphenyl, acetamidephenyl, propioamidephenyl and dodecyloylamidophenyl).

Suitable polymer dispersants can have other recurring units copolymerized with those represented by formula (I). Such copolymerization components may consist of any monomer copolymerizable with the monomers corresponding to the recurring unit represented by formula (I).

The ratio of the polymer component represented by formula (I) to the total quantity of the polymer dispersant should preferably be not less than 50% by weight, and more preferably not less than 60% by weight.

Practical examples of such a polymer dispersant are the dispersion stabilizing resin (Q-1) used in the following example and some commercially available products such as Solprene 1205 of Asahi Kasei Corp.

The polymer dispersant is preferably added beforehand into the polymerization system for the preparation of the above-described resin (P) in the form of a latex.

The added amount of the polymer dispersant is roughly from 1 to 50% by weight based on the particulate resin (P).

The colored particles (or the colorant particles) and the dispersed particulate resin present in the oily ink of the invention are preferably electroscopic particles charged in positive or negative polarity.

To impart electroscopicity to these particles, the technologies used for the preparation of electrophotographic liquid toner are preferably employed. Specifically, the electroscopic materials and optional additives described in *Saikin no Denshi-shashin Genzo Sisutemu to Tonah Zairyo no Kaihatsu Jitsuyoka* (Recent Electrophotographic Developing Systems and Development of Toner Materials) cited hereinabove, pp. 139 to 148, *Denshi-shashin Gijutsu no Kiso to Ohyo* (Fundamentals and Applications of Electrophotographic Technologies), edited by The Society of Electrophotography of Japan (Corona Publishing Co., Ltd., 1988), pp. 497 to 505, and Yuji Harasaki, *Denshi-shashin* (Electrophotography), 16 (2), p. 44 (1977) can be used for that purpose.

Specific examples are described in, for example, Brit. Patent Nos. 893429, 934038, and 1122397, U.S. Pat. Nos. 3,900,412 and 4,606,989, Japanese Patent Laid-Open Nos. 179751/1985, 185963/1985 and 13965/1990.

The above-described charge controlling agents are preferably added to 1000 parts by weight of the dispersing medium as a carrier in an amount of from 0.001 to 1.0 parts by weight. Various additives may be incorporated further. The upper limit for the total amount of such additives is decided by the resistance of the oily ink: when the specific resistance of the liquid phase obtained by removing the dispersed particles becomes lower than $10^9$ Ωcm, good quality continuous tone images can hardly be obtained. Hence, the added amount of various additives must be controlled within these limits.

EXAMPLES

In the following, some examples will be illustrated for a more detailed description of the invention, but the scope of the invention is not limited thereto.

First of all, a preparation example of resinous particles (PL-1) used for the ink will be described.

Preparation Example 1

Preparation of Resinous Particles (PL-1)

A mixture consisting of 10 g of a polymer dispersant (Q-1) having the formula below, 100 g vinyl acetate and 384 g Isopar H was heated to 70° C. under stirring in a nitrogen atmosphere. The mixture was then added with 0.8 g of 2,2'-azo-bis(isovaleronitrile) (A.I.V.N.) as a polymerization initiator, and allowed to react for 3 hours. In 20 minutes after the addition of the initiator, the mixture turned turbid and the temperature rose to 88° C. After, with further addition of 0.5 g of the initiator, the mixture was allowed to react for 2 hours, the temperature of the system was raised to 100° C. and the mixture was agitated for 2 hours to remove the remaining vinyl acetate by distillation. The reaction mixture was filtered with a 200-mesh nylon cloth after cooling to give a white dispersion comprising a mono-disperse, stable latex of 0.23 μm average particle diameter with a polymerization rate of 90%. The particle diameter was measured with CAPA-500, a product of Horiba, Ltd.

Polymer dispersant (Q-1)

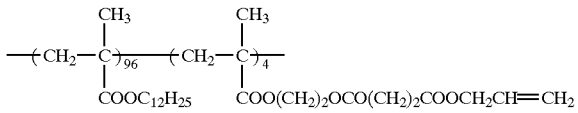

Mw: $5\times10^4$ (Copolymerization ratio is expressed by weight ratio.)

Part of the white dispersion obtained above was centrifuged (at $1\times10^4$ r.p.m. for 60 min), and the resulting sedimented polymer particles were collected and dried. The weight-averaged molecular weight (Mw: polystyrene-equivalent GPC value) of the polymer was $2\times10^5$ and its glass transition temperature (Tg) was 38° C.

Example 1

First, an oily ink was prepared.

<Oily ink (IK-1)>

A fine dispersion of nigrosine was prepared by grinding 10 g of a dodecyl methacrylate/acrylic acid copolymer (copolymerization ratio: 95/5 in weight %), 10 g of nigrosine and 30 g of Shellsol 71 in a paint shaker (a product of Toyo Seiki Co., Ltd.) together with glass beads for 4 hours.

An oily black ink was prepared by diluting 30 g (as the solid content) of the particulate resin (PL-1) described in Preparation Example 1, 20 g of the nigrosine dispersion prepared above, 15 g of FOC-1400 (tetradecyl alcohol produced by Nissan Chemical Industries, Ltd.) and 0.08 g of an octadecene-maleic acid half octadecylamide copolymer with one liter Isopar G.

Oily ink IK-1 thus prepared was charged by 2 liters in the ink tank of the inkjet recording unit in the printing apparatus shown in FIG. 15. In this example, a full-line type head of 900 dpi shown in FIG. 5 was used as the ejecting head. A piezo-electric pump was adopted for ink supply. By installing in the ink tank 25 a throw-in heater and agitating blades 71 (a Ramond stirrer made by Tokai Riki Co., Ltd. with catalog number ST02) as ink temperature-controlling members, the ink temperature was kept at 30° C. Along with the rotation of agitating blades 71 at 30 rpm, a thermostat was used for temperature control. This agitating member was driven by a agitating motor 70 (a simplified agitator of Tokai Riki Co., Ltd. with a catalogue number K-1R) and used also for the prevention of precipitation and aggregation as is shown in FIG. 3. The inflow channel of ink was made partly transparent, a LED light-emitting element and a light-detecting element were arranged so that the transparent part is positioned between the two elements, and the ink concentration was controlled by adding an ink diluent (Isopar G) or an ink concentrate (having a solid concentration twice as much as that of ink IK-1 described above) to the tank according to the output signals.

As the printing medium, a rolled light weight-coated paper was mounted on the counter drum and conveyed. After the dusts present on the surface of the printing medium were eliminated by suction with an air pump, the ejecting head was moved to the imaging position close to the printing medium, the image data to be printed was transmitted to the image data processing-controlling unit, and an image was formed by ejecting the oily ink from the full-line, multi-channel heads with conveying the printing medium by the rotation of the counter drum. In the recording, the tip width of the ejecting electrode was set to 10 μm while the spacing between the head and the printing medium was adjusted to 1 mm by using an optical gap-detecting device. Toabias voltage of 2.5 KV always applied to the ejecting electrode, a pulse voltage of 500 V was superimposed for ink ejection whereby the dot area was controlled by changing the voltage pulse width in 256 steps ranging from 0.2 to 0.05 msec. Imperfect image recording due to the contamination with foreign matters such as ink aggregates or dusts was not observed at all, and image deterioration caused by dot diameter fluctuation due to the ambient temperature variation and the increment of printing time was not observed at all, too. In such a manner, good printing was consistently feasible.

The image was enhanced by heating with a xenon flash fixing device (a product of Ushio, Inc., having an emission intensity of 200 J/pulse). After printing, the inkjet recording unit was retreated away from the recording position close to the drum by 50 mm for the protection of the ink-ejecting recording head.

The resulting printed matters showed sharp and crisp images free of void or blur. Head cleaning was performed for 10 minutes after printing by supplying Isopar G to the head and dripping the solvent from the head aperture. Thereafter, by keeping the head in a cover filled with the vapor of Isopar G, good printed matters could be obtained without any additional maintenance operation over the period of three months.

In these three months, when printing was suspended for a week, ink deposited at the tank bottom forming a bulky aggregate, which was readily redispersed in a short period of operation of the agitator prior to image recording to restore a finely dispersed ink condition. Accordingly, desirable printings were possible.

Example 2

Figure 12:
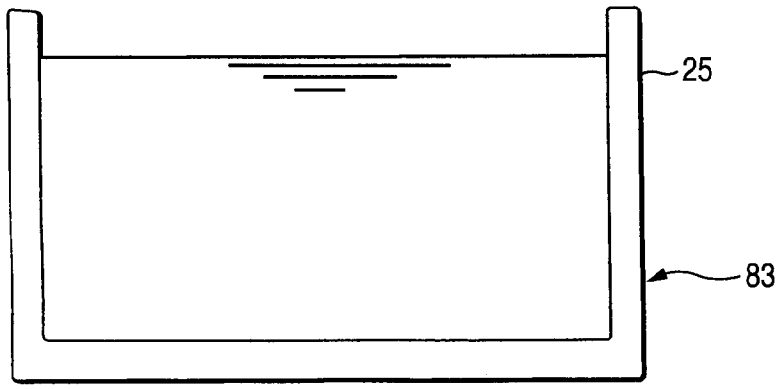
[FIG. 12]

The printing apparatuses shown in FIGS. 16 and 17 were employed, and in an inkjet recording unit 24 shown in FIG. 2 the aggregation and/or precipitation-preventing member and/or the redispersing member (comprising agitating motor 70 and agitating blades 71) as an agitating member (27 in FIG. 1) was replaced to an underwater pump 72 as shown in FIG. 12. Further, four 150 dpi 64 channels multi-channel heads shown in FIG. 5 were used in such an arrangement that the ejecting parts for 64 channels were arrayed perpendicular to the drum axis direction. Micro-gear pumps (made by Chuo Rika Kogyo, Corp.) were used for ink circulation, and ink reservoirs were provided between each pump and the ink inflow channel in the ejecting head, and between each ink recovery channel in the ejecting head and each ink tank. The ink was circulated by the hydrostatic pressure difference therebetween. As the ink temperature-controlling member, a heater and the above-described pumps were used. The ink temperature was set at 35° C. and regulated with a thermostat. The circulation pump which is an underwater pump shown as 72 in the figure having a tradename of Rei-sea Pump (catalog number: P-112) made by Rei-Sea Co., Ltd. served also as an aggregation and/or precipitation-preventing member and/or a redispersing member. Further, in the ink inflow channel was placed an electric conductance-measuring device, the signals from which were used for ink concentration control by replenishing an ink diluent or concentrate.

After dust removal with a nylon rotary brush, the image data to be printed was transmitted to the image data processing-controlling unit, main scanning was performed by moving the head in the direction of the drum axis, and at the same time, sub-scanning was performed by rotating the imaging drum. Thus, an image was formed with the ejected inks on a rolled light weight-coated paper.

As the oily inks, black ink IK-1, cyan ink IK-2 which was prepared in the same manner as IK-1 except that nigrosine used as ink colorant was replaced with phthalocyanine blue, magenta ink IK-3 which was prepared in the same manner as IK-1 except that nigrosine used as ink colorant was replaced with C.I. Pigment Red 57:1, and yellow ink IK-4 which was prepared in the same manner as IK-1 except that nigrosine used as ink colorant was replaced with C.I. Pigment Yellow 14 were used. These inks were charged in the four heads, respectively.

Image defect due to ink aggregates or dusts was not observed at all, and image deterioration due to dot area fluctuation was not observed at all, too, even under a drifting external atmospheric temperature and/or with the increase of the number of printed sheets. Excellent single-sided as well as double-sided full-color printing was carried out either with use of the head shown in FIG. 5 or FIG. 7.

Head cleaning was performed after printing by circulating Isopar G in the heads, and thereafter bringing a piece of nonwoven fabric impregnated with Isopar G into contact with the tip of the head. Good printed matters could be produced with necessitating no maintenance work over the period of three months.

A high-quality image recording was consistently achieved when a 150 dpi, 64 channel multi-channel head of the type depicted in FIG. 7 was used in a similar manner instead of the one of the type depicted in FIG. 5 due to the use of the agitating member.

Example 3

Single-sided four-color full color printing was performed with the printing apparatus shown in FIG. 19. Each of the four kinds of inks used in Example 2 was charged as the oily ink in each of the four inkjet imaging units, respectively. Four 100 dpi, 256 channel multi-channel heads shown in FIG. 9 were used whereby the ejecting parts were arranged parallel to the axis of the counter drum. Counter drum rotation conducted main scanning, and a 900 dpi image was formed on a coated paper by moving the heads stepwise after each revolution in the direction of the drum axis. Sharp and crisp, high-quality full-color printed matters were obtained without any image defect due to the contamination of ink aggregates or other foreign matters, or the presence of dusts.

Example 4

Single-sided four-color full color printing was carried out with the printing apparatuses shown in FIGS. 21 and 22. The same four kinds of color inks as used in Example 3 were used. As the ejecting heads, 600 dpi, 64 channels multi-channel heads shown in FIG. 5 were adopted whereby the ejecting points were arranged so as to form an angle of about 600 with the transport direction of the printing medium. The image data to be printed was transmitted to the image data processing-controlling unit, and a 700 dpi image was formed on a dedicated inkjet recording paper by conveying the printing medium by the rotation of the capstan rollers along with moving the 64 channels multi-channel heads in the direction perpendicular to the conveyance direction of the printing medium.

Figure 13:
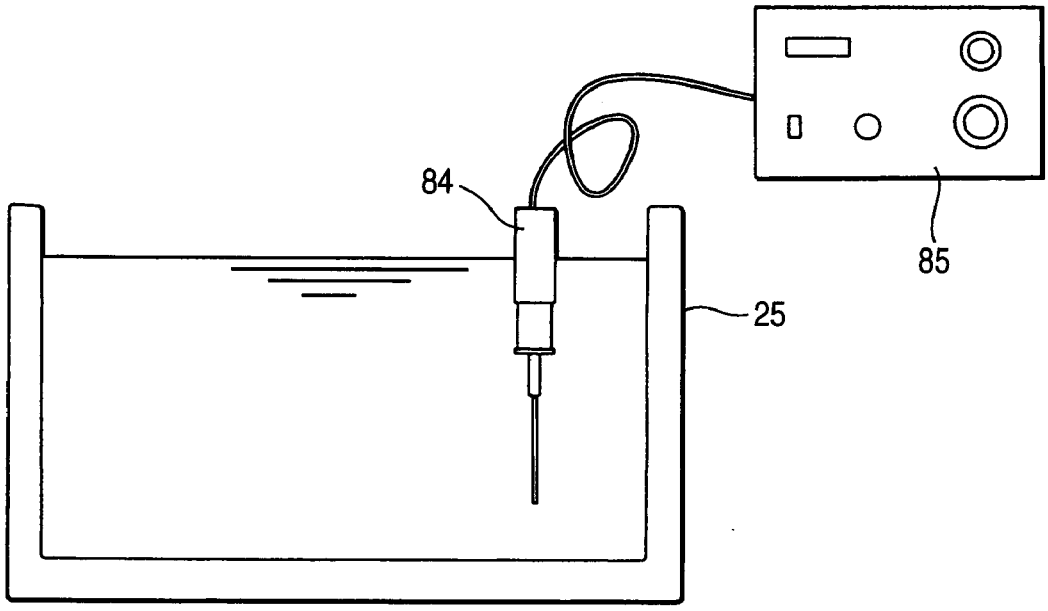
[FIG. 13]

Instead of agitating blades 71 used in Example 1, an aggregation and/or precipitation-preventing member and/or a redispersing member depicted in FIG. 13 was adopted. That is, an agitating element 81 (Starhead Agitator (size 58) made by Tokai Riki Co., Ltd.) was thrown into ink tank 25, and rotated by means of a magnetic stirrer (with catalog number HS-50E, made by Tokai Riki Co., Ltd.) arranged outside of ink tank 25. Otherwise, the same procedures were repeated as in Example 1.

A desirable four-color full-color printing resulted, giving high-quality prints free of image defect due to the contamination of ink aggregates or foreign matters such as dust.

Example 5

Figure 14:
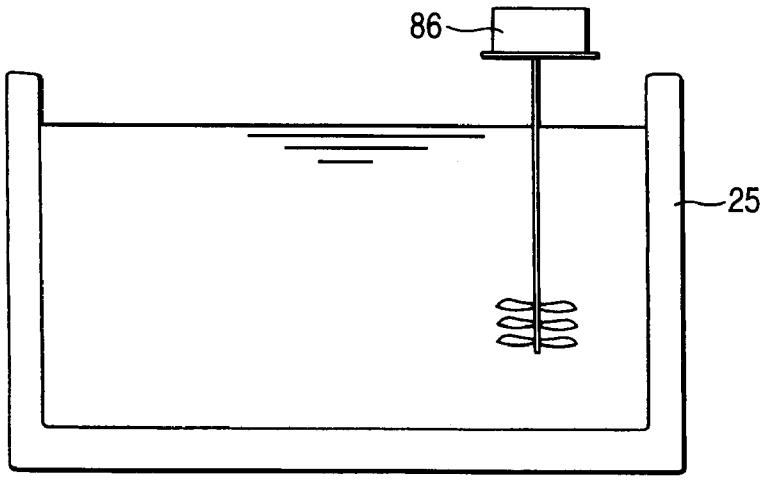
[FIG. 14]

Instead of agitating blades 71 used in Example 1, an aggregation and/or precipitation-preventing member and/or a redispersing member depicted in FIG. 14 was adopted. That is, an ultrasonic wave-applying tub 83 (Ultrasonic Cleaner with a catalogue number USK-2 made by Tokai Riki Co., Ltd.) was used to disperse ink by ultrasonic vibration.

Example 6

Instead of agitating blades 71 used in Example 1, an aggregation and/or precipitation-preventing member and/or a redispersing member depicted in FIG. 15 was adopted. That is, an oscillating element 84 (ϕ5) was thrown into ink tank 25 whereby oscillating element 84 was oscillated by means of oscillator 85 (Ultrasonic dispersing device with a catalogue number UH-50, made by Tokai Riki Co., Ltd.) to disperse ink.

Example 7

Instead of agitating blades 71 used in Example 1, a re-agitating member depicted in FIG. 16 was adopted. That is, into ink tank 25 was thrown in multi-stage-type oscillating blades 86 (a single axis type) to which a low frequency wave was transmitted from oscillator 87 (α-stirrer, an ultra-oscillator made by Nihon Techno Co., Ltd.) via oscillating blades 86 to agitate the ink by a low-frequency vibration. Since the agitation in Example 7 is caused not by the rotation of agitating blades as in Example 1, but by the vibration of the oscillating blades, air is not mixed in the ink at all. Moreover, due to no blade rotation, the agitating member can be placed at the extreme side end of an ink tank with an expanded degree of freedom in the selection of installation position.

On the other hand, in cases where image recording was carried out without using any agitating and dispersing member in Examples 1 to 7, ink ejection became unstable in from several hours to several days of operation for every Example. And after the output of disordered images and the failure in ink ejection lasted for some time, the ejecting aperture of the head was completely choked with coarse, half-solidified aggregates of the ink particles in the worst case, thus image recording becoming entirely impossible.

In cases where image recording was re-started after 3 to 10 days suspension of ink-flow without performing any agitating or dispersing operation in Examples 1 to 7, ink ejection was unstable accompanying a continued disorder of images or showing a continuing non-ejecting state. In the worst case, the ejecting aperture of the head was completely choked with coarse, half-solidified aggregates of the ink particles, thus image recording becoming entirely impossible.

The redispersing members described in the above examples to prevent aggregation and/or precipitation include those of large sizes designed for production lines. Such members are preferably modified and made smaller to meet the dimension of ink tanks and the capability required for the present purpose prior to the application to printing apparatuses associated with the invention.

According to the invention, in the method of producing printed matters by forming an image directly on a printing medium on the basis of image data signals, said image formation being performed by an inkjet method in which an oily ink is ejected by making use of an electrostatic field, and fixing the image, it becomes possible to achieve printing accompanying no image blur on ordinary papers for printing or non-absorptive plastic sheets, etc., not demanding the use of expensive dedicated papers, since a member for preventing the aggregation and/or precipitation of oily ink such as an ink-agitating member is provided and/or the oily ink is redispersed whereby the ink fed to the ejecting head is not contaminated with foreign matters such as ink aggregates. The method also enables ejection of minute liquid droplets leading to the formation of dots of a small area and thickness. Accordingly, high-quality image information such as of photographic images can be outputted inexpensively in a high output speed.

What is claimed is:

1. Inkjet printing method comprising:

ejecting an oily ink comprising particles to a printing medium with use of an electrostatic field according to image data signals to form an image directly on the printing medium; and fixing the image to obtain a printed matter, wherein a prevention of an aggregation and/or a precipitation of the particles is conducted at least during ink circulation, or an aggregate and/or a deposit of the particles formed at least due to a suspension of ink-flow is redispersed.

2. The inkjet printing method according to claim 1, wherein the oily ink comprises:

a nonaqueous solvent having a specific resistance not less than $10^9$ Ωcm and a dielectric constant not higher than 3.5; and colored particles dispersed in the nonaqueous solvent.

3. An inkjet printing apparatus comprising:

an image-forming means for forming an image directly on a printing medium according to image data signals; and an image-fixing means for fixing the image formed by the image-forming means to produce a printed matter, the image-forming means being an inkjet recording unit comprising a recording head that ejects an oily ink comprising particles with use of an electrostatic field, wherein at least one aggregation and/or precipitation-preventing means is equipped in an ink-flow channel of the oily ink in an ink circulation, the aggregation and/or precipitation-preventing means being for a prevention of aggregation and/or precipitation of the particles, or a redispersing means is equipped, the redispersing means being for redispersing of the particles which are in a state of aggregation and/or precipitation formed due to a suspension of ink-flow.

4. The inkjet printing apparatus according to claim 3, wherein at least one of the aggregation and/or precipitation-preventing means and the redispersing means is located just in front of an ink-ejecting part of the recording head.

5. The inkjet printing apparatus according to claim 3, wherein at least one of the aggregation and/or precipitation-preventing means and the redispersing means comprises from a group of agitation, dispersion, mixing and jetting.

6. The inkjet printing apparatus according to claim 5, wherein the group of agitation, dispersion, mixing and jetting is applied individually or in combination.

7. The inkjet printing apparatus according to claim 6, wherein the group of agitation, dispersion, mixing and jetting is applied with a fixed interval, with a non-fixed interval or continuously.

8. The inkjet printing apparatus according to claim 3, wherein at least one of the aggregation and/or precipitation-preventing means and the redispersing means is in the form of a cartridge.

9. The inkjet printing apparatus according to claim 3, wherein the oily ink comprises:

a nonaqueous solvent having a specific resistance not less than $10^9$ Ωcm and a dielectric constant not higher than 3.5; and colored particles dispersed in the nonaqueous solvent.

10. The inkjet printing apparatus according to claim 3, which further comprises a dust-removing means that removes dusts present on a surface of the printing medium prior to and/or during printing.

11. The inkjet printing apparatus according to claim 3, wherein the image forming is carried out by moving the printing medium through a rotation of a counter drum arranged in a position facing the recording head with the printing medium interposed between the recording head and the drum.

12. The inkjet printing apparatus according to claim 11, wherein the recording head is of a single-channel or multi-channel type and the image forming is carried out by moving the recording head in the direction parallel to the axis of the counter drum.

13. The inkjet printing apparatus according to claim 11, wherein the recording head is of a full-line type having a width substantially equal to that of the printing medium.

14. The inkjet printing apparatus according to claim 3, wherein the image forming is carried out by transporting the printing medium inserted between at least a pair of capstan rollers.

15. The inkjet printing apparatus according to claim 13, wherein the recording head is of a single-channel or multi-channel type, and the image forming is carried out by moving the recording head along the direction perpendicular to the moving direction of the printing medium.

* * * * *